US009615414B2

(12) United States Patent
Hamamoto et al.

(10) Patent No.: US 9,615,414 B2
(45) Date of Patent: Apr. 4, 2017

(54) POWER SUPPLY DEVICE AND ILLUMINATION DEVICE

(71) Applicant: PANASONIC INTELLECTUAL PROPERTY MANAGEMENT CO., LTD., Osaka (JP)

(72) Inventors: Katsunobu Hamamoto, Osaka (JP); Yasunori Yamamura, Nara (JP); Tetsushi Tamura, Niigata (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/812,260

(22) Filed: Jul. 29, 2015

(65) Prior Publication Data

US 2016/0065085 A1 Mar. 3, 2016

(30) Foreign Application Priority Data

Sep. 1, 2014 (JP) ..... 2014-177339

(51) Int. Cl.
*F21V 17/16* (2006.01)
*F21V 23/00* (2015.01)
(Continued)

(52) U.S. Cl.
CPC ..... *H05B 33/0815* (2013.01); *F21V 17/164* (2013.01); *F21V 23/008* (2013.01);
(Continued)

(58) Field of Classification Search
CPC ..... H02M 7/06; H02M 1/14; H05B 33/0815
USPC ... 315/294, 122, 187, 193, 209 R, 246, 282; 362/249.01, 294, 249.02, 268, 307, 362/311.02, 606, 611; 361/692, 748, 760,
(Continued)

(56) References Cited

U.S. PATENT DOCUMENTS

2014/0001952 A1* 1/2014 Harris ..... H05B 37/0272 315/51
2016/0088693 A1* 3/2016 Zhao ..... H05B 33/0818 315/51

FOREIGN PATENT DOCUMENTS

JP 2014-086166 5/2014

OTHER PUBLICATIONS

Power Integrations (DER-384) Oct. 8, 2013.*
Jee Labs (More box options); Nov. 2010 http://jeelabs.org/2010/11/24/more-box-options/.*

* cited by examiner

*Primary Examiner* — Alexander H Taningco
*Assistant Examiner* — Renan Luque
(74) *Attorney, Agent, or Firm* — Greenblum & Bernstein, P.L.C.

(57) ABSTRACT

A power supply device includes a power supply input portion, a rectification portion, a smoothing portion, a power conversion portion, a power supply output portion, a signal input portion, a control portion, a circuit substrate, and a case. The circuit substrate is formed in an elongated rectangular plate-like shape. The power supply input portion is mounted on a first end portion of the circuit substrate in a longitudinal direction. The rectification portion, the smoothing portion, the power conversion portion, the control portion, and the power supply output portion are mounted on the circuit substrate in the stated order from the first end portion toward a second end portion in the longitudinal direction. The signal input portion is mounted at a position closer to the second end portion than the rectification portion in the circuit substrate.

4 Claims, 22 Drawing Sheets

(51) Int. Cl.
*F21Y 115/10* (2016.01)
*H05B 33/08* (2006.01)

(52) U.S. Cl.
CPC ..... *H05B 33/0803* (2013.01); *H05B 33/0872* (2013.01); *F21Y 2115/10* (2016.08)

(58) Field of Classification Search
USPC .. 361/306.1, 502, 622, 679.01, 679.21, 720, 361/730, 752, 761, 767, 809
See application file for complete search history.

POWER SUPPLY DEVICE AND ILLUMINATION DEVICE

CROSS-REFERENCE TO RELATED APPLICATION

This application claims the benefit of priority of Japanese Patent Application Number 2014-177339, filed on Sep. 1, 2014, the entire contents of which are hereby incorporated by reference.

TECHNICAL FIELD

This disclosure relates to power supply devices and illumination devices, and specifically relates to a power supply device that converts an AC voltage (AC current) to a DC voltage (DC current), and supplies the DC voltage (DC current) to a load, and an illumination device including the power supply device and a light source serving as the load.

BACKGROUND ART

A lighting fixture (illumination device) described in JP 2014-86166 A (hereinafter referred to as "Document 1") is illustrated as a conventional example. The lighting fixture of the conventional example is a line type lighting fixture that is provided in an embedded state on a ceiling, and includes an elongated main body, a light source, and a lighting apparatus (power supply device).

The light source is constituted by a plurality of light-emitting diodes (LEDs) being mounted on a mounting substrate. The lighting apparatus includes a power supply unit, an individual control unit, a signal terminal board, and a power supply terminal board. Note that the lighting apparatus is configured such that the configuration thereof can be selected from a configuration in which the individual control unit is included and a configuration in which the individual control unit is not included.

The power supply unit includes a case shaped like a rectangular parallelepiped, and a signal input terminal and a power input terminal are arranged side by side in a short direction of the case in one end portion in a longitudinal direction of the case. An external power supply (such as an AC power supply having an effective value of 100 V or 200 V) is electrically connected to the power input terminal. Also, the signal input terminal is electrically connected to the signal terminal board directly or via the individual control unit. Furthermore, an output terminal is provided in the other end portion in the longitudinal direction of the case. The light source is electrically connected to the output terminal. The power supply unit is configured to convert an AC voltage (AC current) that is received from the power input terminal to a DC voltage (DC current), and output the DC voltage (DC current) from the output terminal.

Control signals for controlling lighting of the light source directly or via the individual control unit are inputted to the signal terminal board from the outside of the lighting fixture. The external control signals include a signal from a human sensor that monitors the presence or absence of a person inside a detection area, a signal from a brightness sensor that monitors the brightness in the detection area, a signal from a wall switch on which manual operations such as turning on or off and selecting a scene are performed.

The individual control unit receives an external control signal via the signal terminal board, and acquires address data and control command data that are included in the external control signal. The individual control unit then outputs, when the acquired address data matches its own address data, a light modulation signal (such as a PWM light modulation signal) based on the acquired control command data to the signal input terminal of the power supply unit.

The power supply unit controls the magnitude of the output electric power and power supply time (lighting time) based on the PWM light modulation signal that is inputted to the signal input terminal, and controls the lighting state of the light source.

In the conventional example described in Document 1, the operations of the power supply unit with respect to the external control signal can be changed according to the presence or absence of the individual control unit, as described above.

Incidentally, in the power supply unit of the above conventional example, the signal input terminal to which the individual control unit is electrically connected is arranged adjacent to the power input terminal. Therefore, it has been difficult to miniaturize the power supply unit, if a spatial distance regulated by law (Electrical Appliances and Materials Safety Act, in Japan) between the signal input terminal and the power input terminal is to be secured.

SUMMARY OF THE INVENTION

The present technology has been made in view of the above-described problems, and an object of the present technology is to realize miniaturization compared with a conventional example while securing the spatial distance between a power supply input portion and a signal input portion.

A power supply device according to an aspect of the present invention includes a power supply unit. The power supply unit includes: a power supply input portion configured to receive an AC voltage from the outside of the power supply unit; a rectification portion configured to rectify the AC voltage that is received by the power supply input portion; a smoothing portion configured to smooth a pulsating voltage that is outputted from the rectification portion; a power conversion portion configured to convert, to a second DC voltage, a first DC voltage that is outputted from the smoothing portion; a power supply output portion configured to output, to the outside, the second DC voltage that is converted in the power conversion portion; a signal input portion configured to receive a control signal from the outside; a control portion configured to control the power conversion portion to change the magnitude of the second DC voltage, which is to be outputted from the power supply output portion to the outside, based on the control signal that is received by the signal input portion; a circuit substrate on which the power supply input portion, the rectification portion, the smoothing portion, the power conversion portion, the power supply output portion, the signal input portion, and the control portion are mounted; and a case that houses the circuit substrate. The circuit substrate is formed in an elongated rectangular plate-like shape. The power supply input portion is mounted on a first end portion of the circuit substrate in a longitudinal direction. The rectification portion, the smoothing portion, the power conversion portion, the control portion, and the power supply output portion are mounted on the circuit substrate in the stated order from the first end portion toward a second end portion in the longitudinal direction. The signal input portion is mounted at a position closer to the second end portion than the rectification portion in the circuit substrate.

An illumination device according to an aspect of the present invention includes: the power supply device; and an illumination load that is lighted by the second DC voltage supplied from the power supply device.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Power supply devices and illumination devices according to Embodiments 1 to 5 will be described in detail with reference to the drawings. Note that although the illumination device of each of the embodiments will be exemplified by a lighting fixture that is to be attached to a ceiling, the illumination device of each of the embodiments may be a lighting fixture that is to be attached to a place other than a ceiling such as a wall. Also, in the following description, unless otherwise specifically noted, the vertical and horizontal directions shown in FIG. 2 are respectively defined as the vertical and horizontal directions, and furthermore, a direction vertical to the paper surface in FIG. 2 is defined as the front-back direction (the near side is the front side).

Embodiment 1

Figure 1:
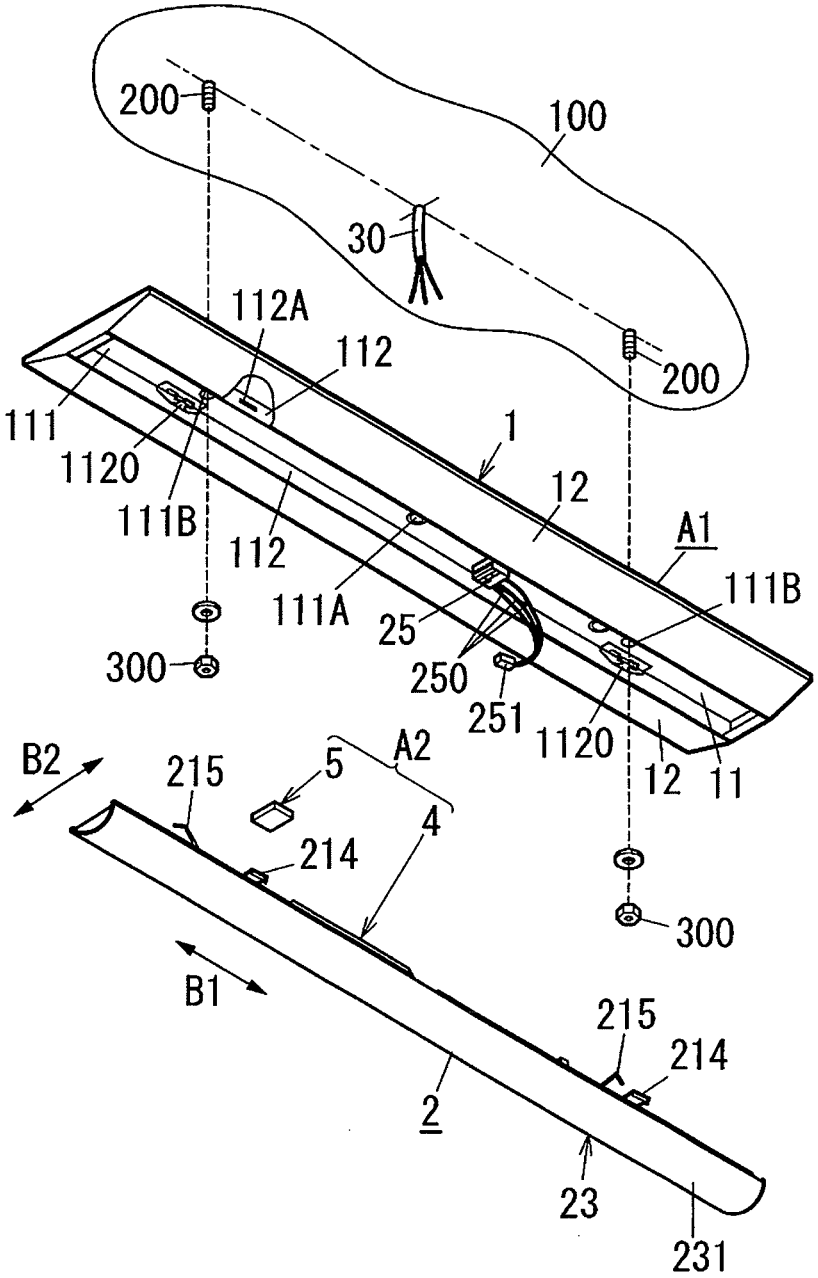
FIG. 1 is an exploded perspective view of a power supply device and an illumination device according to Embodiment 1.
Figure 2:
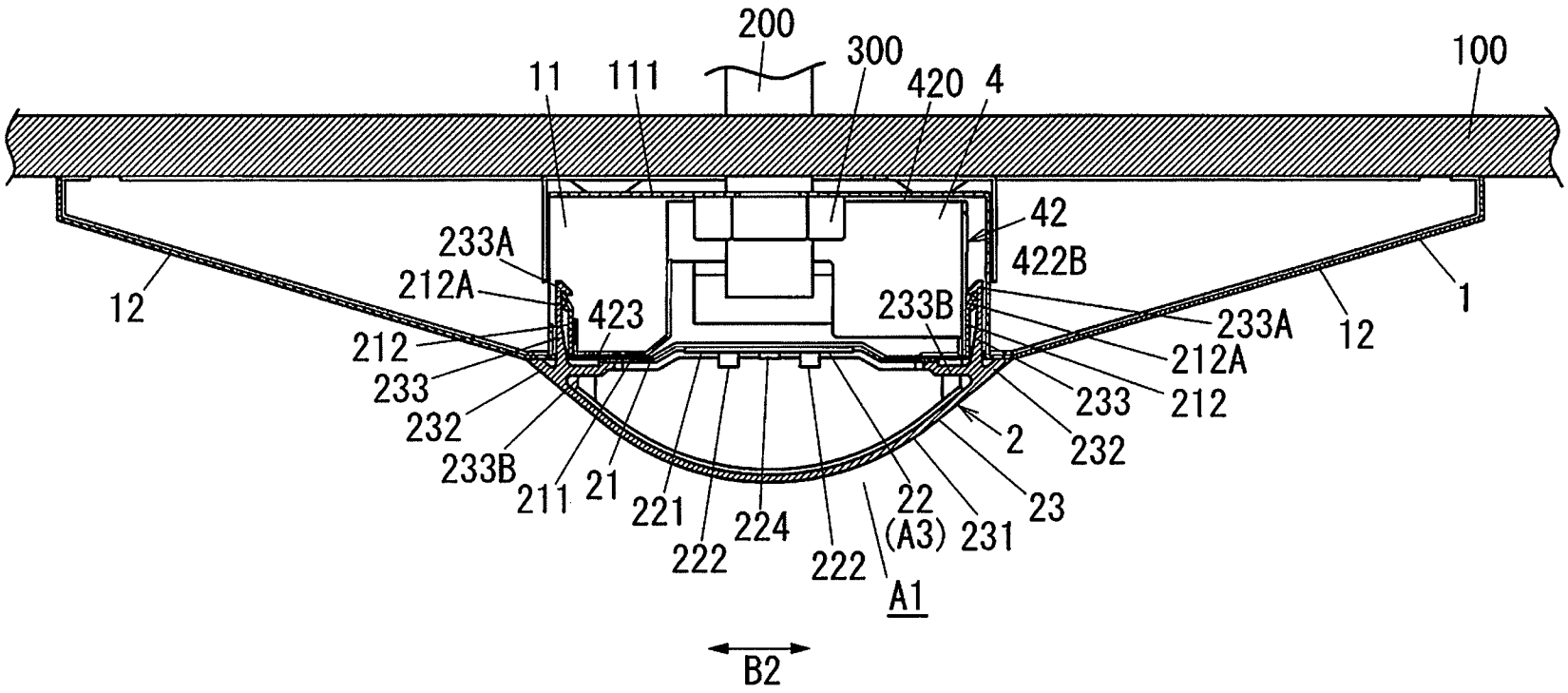
FIG. 2 is a cross-sectional view of a lighting fixture according to Embodiment 1.

A lighting fixture A1 of the present embodiment includes a light source unit 2 and a fixture body 1, as shown in FIGS. 1 and 2. The fixture body 1 is fixed to hanging bolts 200, and is directly attached to a ceiling 100. The light source unit 2 is detachably mounted to the fixture body 1.

The fixture body 1 is formed in an elongated flat box-like shape whose upper surface (a surface opposing to the ceiling 100) is open by bending a sheet metal. Also, the fixture body 1 is provided with, on a side opposite to the ceiling 100 (lower side), a rectangular recessed portion 11 for housing the light source unit 2 over the entire length of the fixture body 1 in a longitudinal direction (front-back direction) B1. Also, inclined portions 12 are provided on two sides of the recessed portion 11 in a width direction (horizontal direction) B2 of the fixture body 1. The inclined portions 12 extend in the width direction B2 of the fixture body 1 from respective opening edges of the recessed portion 11 and incline upward toward the outside.

Also, a hole 111A for passing a power supply line 30 is provided in a bottom plate 111 of the recessed portion 11 at the approximately center thereof in the longitudinal direction (front-back direction) B1. Furthermore, the bottom plate 111 is provided with holes 111B that are each for passing a hanging bolt 200 at places close to respective ends in the longitudinal direction (front-back direction) B1. A terminal board 25 is mounted on a lower surface of the bottom plate 111. The terminal board 25 is electrically connected to the power supply line 30. Three electric wires 250 including a ground line are led out from the terminal board 25. Furthermore, the tips of the three electric wires 250 are electrically connected to a plug connector 251.

The light source unit 2 includes an illumination load A3, a mounting member 21, a cover 23, and a power supply device A2, as shown in FIGS. 1 and 2. The power supply device A2 includes a power supply unit 4 and a functional unit 5. The illumination load A3 includes two or more (two, for example) LED modules 22.

The two or more LED modules 22 are arranged side by side in the longitudinal direction (front-back direction) B1. Each LED module 22 includes a mounting substrate 221 formed in a rectangular plate-like shape that is elongated in the longitudinal direction (front-back direction) B1. A plurality of LEDs (light-emitting diodes) 222 are mounted on a lower surface of the mounting substrate 221 to form two lines along the longitudinal direction (front-back direction) B1. Also, a connector is mounted on a front end portion of any one of the two or more LED modules 22. The connector is for providing electric connection between the LED module 22 and the power supply unit 4. Output lines 43 of a power supply unit 4, which will be described later, are electrically connected to the connector.

A connector 224 for power supply is mounted in each of the end portions, of the LED modules 22, which opposes an adjacent LED module 22 (refer to FIG. 2). The connectors 224 of adjacent LED modules 22 are electrically connected, and as a result lighting power is relayed from one LED module 22 to the other LED module 22.

The mounting member 21 is formed in a U-like shape by bending a sheet metal, and includes a bottom plate 211 formed in an elongated rectangular plate-like shape and a pair of side plates 212 that extend in the vertical direction (direction orthogonal to the bottom plate 211) from respective ends of the bottom plate 211 in the horizontal direction (width direction). Inclined portions 212A, which form a pair, are provided respectively at leading ends (upper ends) of the two side plates 212, and incline in directions to separate from each other (outward) over the entire length of the respective side plates 212, as shown in FIG. 2.

A hole for passing the output lines 43 of the power supply unit 4 is provided in a front end portion of the bottom plate 211. Also, a rectangular recessed portion formed by causing a portion of the bottom plate 211 to project upward is provided in a central portion of the bottom plate 211 in the front-back direction. The recessed portion is provided to secure a spacing for insulation between each connector 224 and the bottom plate 211 of the mounting member 21 in a state in which the LED modules 22 are mounted on the mounting member 21. Note that the above described LED module 22 is fixed to the mounting member 21 by a claw that is formed by a portion of the bottom plate 211 of the mounting member 21 being cut and raised, for example.

Also, the mounting member 21 includes, in positions close to respective ends in the longitudinal direction, a pair of hooking metal fittings 214 that extend to one end side in the width direction and a pair of hooking springs 215 that are provided on the other end side in the width direction.

The cover 23 is formed in an elongated box shape in which an upper surface (surface on the mounting member 21 side) is open by a material having diffusibility (such as a milky white acrylic resin). Also, the cover 23 includes a curved surface portion 231 having a convex lens shape in which the downward projection amount increases from the two ends toward the center in the horizontal direction (width direction) (refer to FIG. 2).

Extension portions 232 are provided in two end portions of the cover 23 in the horizontal direction. The extension portions 232 overlap respective opening edges of the recessed portion 11 of the fixture body 1 when viewed in the vertical direction in a state in which the light source unit 2 is mounted on the fixture body 1, as shown in FIG. 2. Furthermore, protruding wall portions 233 that project upward (mounting member 21 side) over the entire length of the cover 23 are provided inside the respective extension portions 232 in the horizontal direction of the cover 23. Protruding portions 233A that project inward are provided at respective leading ends of the protruding wall portions 233. Also, support pieces 233B that project inward project from the vicinity of respective bases of the protruding wall portions 233.

Figure 3:
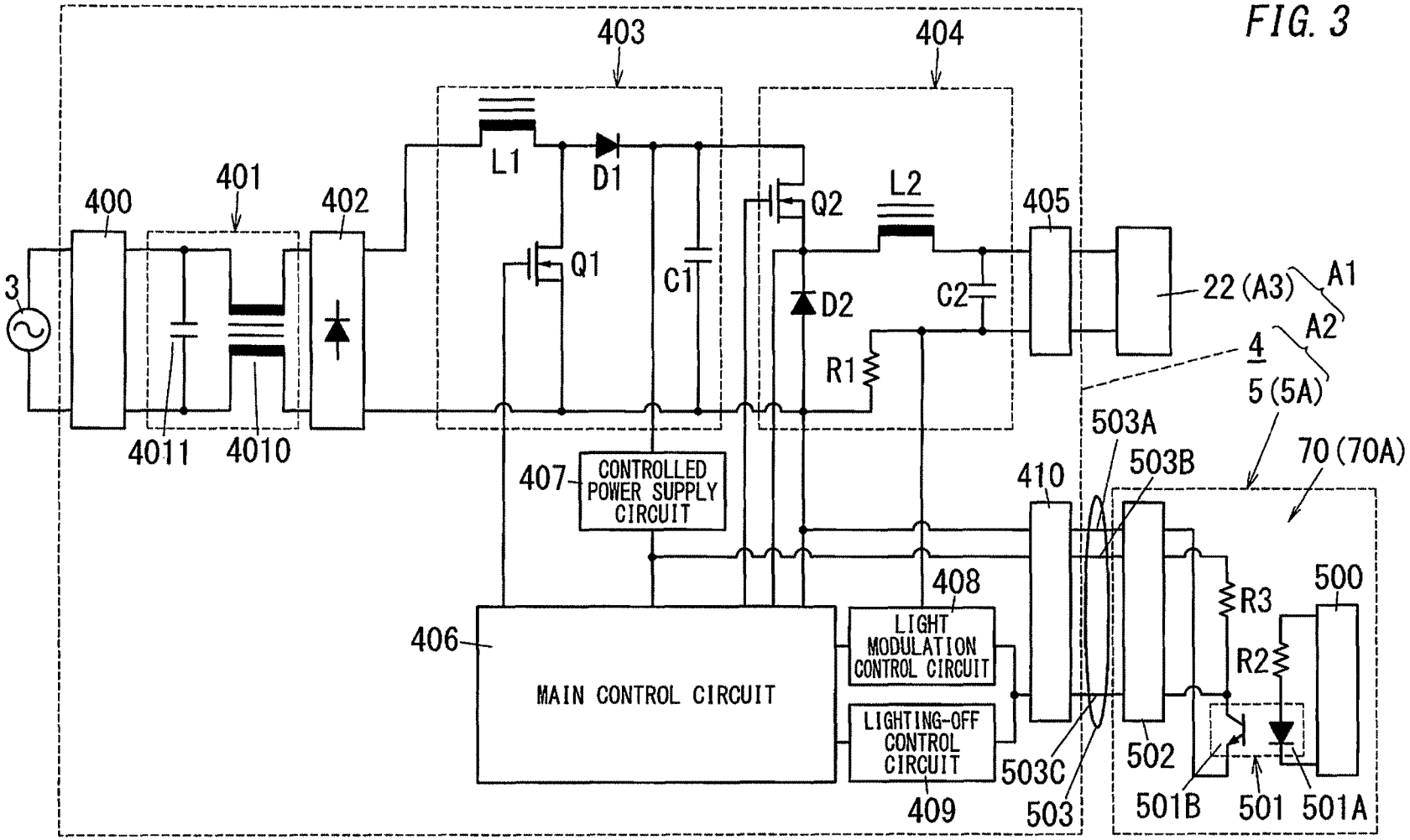
FIG. 3 is a circuit diagram of a power supply unit and a functional unit in Embodiment 1.

The power supply unit 4 includes: a power supply circuit 49 including a first print wiring board 40 on which electronic components are mounted; and a first case 42 that houses the power supply circuit 49. A circuit diagram of the power supply circuit 49 is shown in FIG. 3. The power supply circuit 49 includes a power supply input portion 400, a filter circuit 401, a rectification portion 402, a step up circuit 403, a step down circuit 404, a power supply output portion 405, a main control circuit 406, a controlled power supply circuit 407, a light modulation control circuit 408, a lighting-off control circuit 409, and a signal input portion 410.

The power supply input portion 400 includes a receptacle connector. The plug connector 251 (refer to FIG. 1) that is electrically connected to the electric wires 250 led out from the terminal board 25 is plugged into the power supply input portion 400. The filter circuit 401 includes a common mode choke coil 4010 and an across-the-line capacitor 4011. The rectification portion 402 includes a diode bridge. The rectification portion 402 full-wave-rectifies an AC voltage (AC current) that is inputted from the AC power supply 3 via the filter circuit 401 and the power supply input portion 400, and outputs a pulsating voltage (pulsating current) from a DC output terminal.

The step up circuit 403 includes a choke coil L1, a switching element Q1, a rectifying element D1, and a smoothing capacitor C1, and is a conventionally known step up chopper circuit (power factor correction circuit). The step up circuit 403 converts the pulsating voltage that is outputted from the rectification portion 402 to a DC voltage (DC voltage of 400 V, for example) that is higher than the peak value of the pulsating voltage. That is, in the present embodiment, the step up circuit 403 corresponds to a smoothing portion.

Also, the step down circuit 404 includes a switching element Q2, an inductor L2, a rectifying element D2, a resistor R1, and a smoothing capacitor C2, and is a conventionally known step down chopper circuit (buck converter). The step down circuit 404 steps down the DC voltage (first DC voltage) that is outputted from the step up circuit 403 to a DC voltage (second DC voltage) that is appropriate to the LED module 22 serving as a load. That is, in the present embodiment, the step down circuit 404 corresponds to a power conversion portion. The power supply output portion 405 includes a receptacle connector, and is electrically connected to an output terminal (two ends of the smoothing capacitor C2) of the step down circuit 404.

The main control circuit 406 is configured to turn on and off the switching element Q1 of the step up circuit 403 and the switching element Q2 of the step down circuit 404 such that the output voltage of the step up circuit 403 is kept at a constant level and the output current from the step down circuit 404 matches a target value. The controlled power supply circuit 407 is configured to generate a controlled voltage (DC voltage of approximately 15 V to 3 V, for example) from the output voltage of the step up circuit 403. The main control circuit 406 operates by a controlled voltage that is supplied by the controlled power supply circuit 407.

A signal input portion 410 includes a receptacle connector into which a plug connector 504 of the functional unit 5 is plugged. As will be described later, a control signal that is outputted from the functional unit 5 is inputted to a light modulation control circuit 408 and a lighting-off control circuit 409 via a signal input portion 410.

The lighting-off control circuit 409 is configured to generate a lighting-off signal for turning off the lighted LED module 22 according to the control signal, and to output the lighting-off signal to the main control circuit 406. The main control circuit 406 is configured to, upon receiving the lighting-off signal, stop the turning on and off of the switching element Q2 to stop operation of the step down circuit 404, and to turn off the LED module 22. Note that the main control circuit 406 may be configured to, upon receiving the lighting-off signal, stop the turning on and off of the switching element Q1 in addition to the switching element Q2 to stop operations of both the step up circuit 403 and the step down circuit 404. When both the step up circuit 403 and the step down circuit 404 stop operations as described above, power consumption of the power supply unit 4 when the LED module 22 is turned off can be reduced compared with the case where only the step down circuit 404 stops operation.

Also, the light modulation control circuit 408 is configured to generate a light modulation signal and output the light modulation signal to the main control circuit 406 according to the control signal. The light modulation signal is a signal for designating a light output (light modulation level) of the LED module 22. Note that the light modulation level is represented by a percentage (%) of the average electric power per unit time, which is supplied to the LED module 22, relative to rated electric power assuming that the light output of the LED module 22 is 100% when the rated electric power is supplied. For example, when the average electric power per unit time that is supplied to the LED module 22 is half the rated electric power, the light modulation level is 50%. In other words, if the light modulation level designated by the control signal is 50%, the light modulation control circuit 408 generates a light modulation signal for instructing that the average electric power per unit time that is supplied to the LED module 22 from the step down circuit 404 is to be half the rated electric power. The main control circuit 406 is preferably configured to adjust the duty ratio of the switching element Q2 according to the light modulation signal that is received from the light modulation control circuit 408. More specifically, the light modulation control circuit 408 is preferably configured to detect the output current of the step down circuit 404 from the voltage across the resistor R1, and generate the light modulation signal such that the average value of the output current matches a target value corresponding to the light modulation level. That is, in the present embodiment, the main control circuit 406, the light modulation control circuit 408, and the lighting-off control circuit 409 correspond to a control portion.

Figure 4:
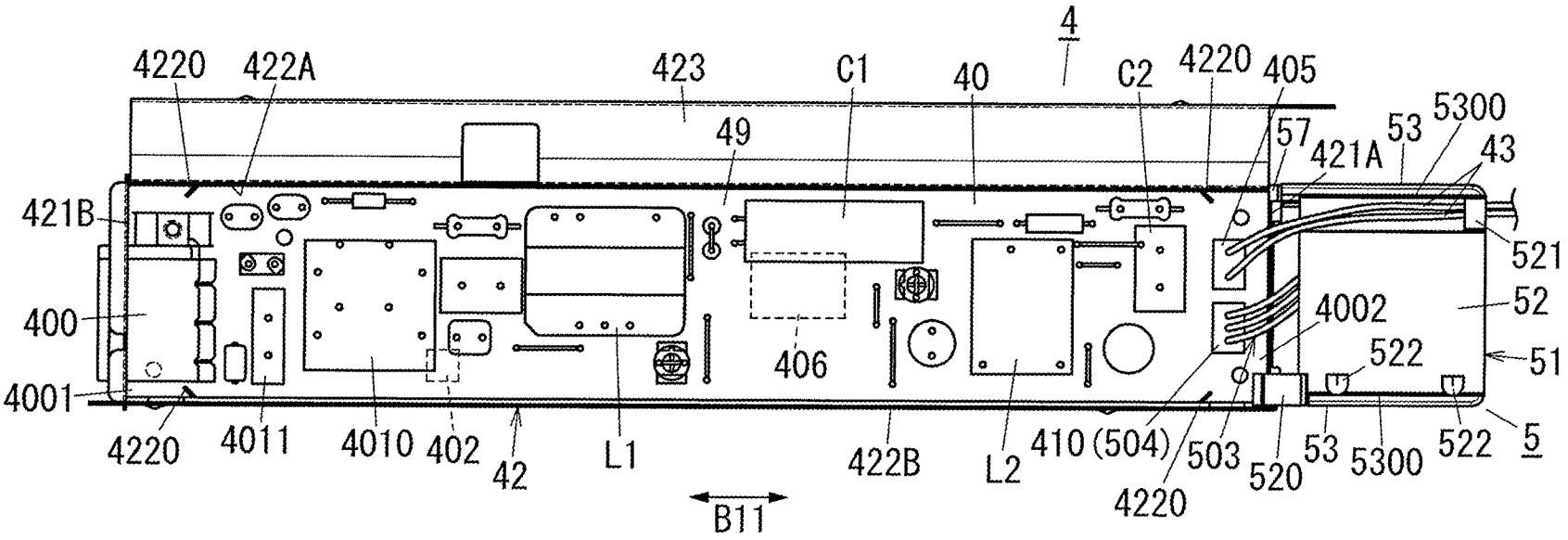
FIG. 4 is a plan view of the power supply unit and the functional unit in Embodiment 1.

The first print wiring board 40 includes an insulating substrate having an elongated rectangular plate-like shape in which a conductor (copper foil) for wiring is printed on a back surface thereof, as shown in FIG. 4. So-called leaded components such as a connector, a smoothing capacitor, and a common mode choke coil 4010 are mounted on a surface of the first print wiring board 40. Also, surface mount components such as a rectification portion 402, a main control circuit 406, a light modulation control circuit 408, and a lighting-off control circuit 409 are mounted on the back surface of the first print wiring board 40. Here, the power supply input portion 400 is mounted on a surface of an end portion (hereinafter referred to as a first end portion 4001) of the first print wiring board 40 in a longitudinal direction B11. On the other hand, the power supply output portion 405 and the signal input portion 410 are mounted on a surface of the other end portion (hereinafter referred to as a second end portion 4002) of the first print wiring board 40 in the longitudinal direction B11. The filter circuit 401, the rectification portion 402, the step up circuit 403, the step down circuit 404, and the power supply output portion 405 are mounted on the first print wiring board 40 in the stated order from the first end portion 4001 toward the second end portion 4002 in the longitudinal direction B11 of the first print wiring board 40. Also, the main control circuit 406, the controlled power supply circuit 407, the light modulation control circuit 408, and the lighting-off control circuit 409 are mounted on the first print wiring board 40 in the stated order from the rectification portion 402 toward the second end portion 4002. Note that the rectification portion 402, which is not illustrated in FIG. 4 due to being mounted on the back surface of the first print wiring board 40, is mounted approximately at a position somewhat closer to the second end portion 4002 than the common mode choke coil 4010. That is, the distance between the rectification portion 402 and the second end portion 4002 is somewhat shorter than the distance between the common mode choke coil 4010 and the second end portion 4002.

Figure 5:
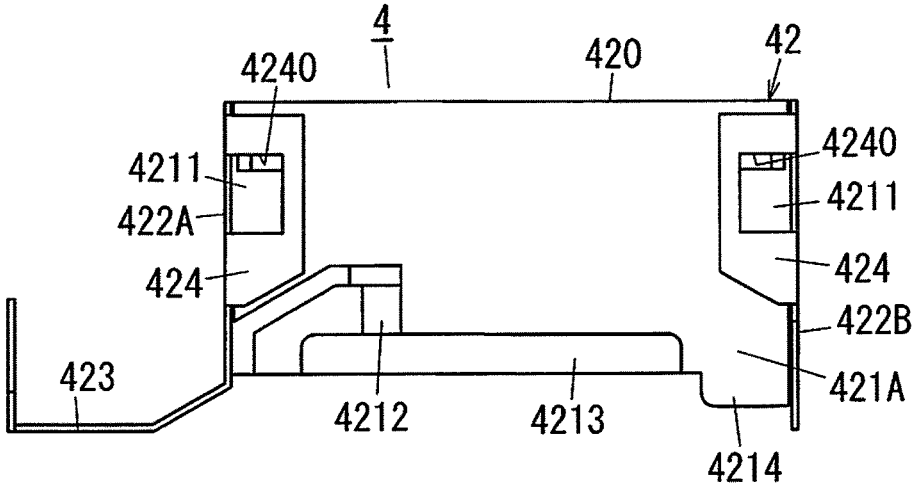
FIG. 5 is a plan view of the power supply unit in Embodiment 1.

The first case 42 includes a bottom plate 420, a pair of first side plates 421A and 421B that rise from respective edges of the bottom plate 420 along a short direction, and a pair of second side plates 422A and 422B that rise from respective edges of the bottom plate 420 along a longitudinal direction, as shown in FIGS. 4 and 5. That is, the first case 42 is formed in an elongated box shape in which a portion in front of the bottom plate 420 is open. Also, the first case 42 includes a fixed plate 423 that projects outward from a leading end of the second side plate 422A, which is one of the pair of second side plates 422A and 422B. The fixed plate 423 is formed in a square gutter-like shape, as shown in FIG. 5.

The first print wiring board 40 is housed in the first case 42 such that the back surface thereof opposes the bottom plate 420 and the second end portion 4002 is on the first side plate 421A side, and is fixed to the first case 42 by four claws 4220 that are cut and raised from the pair of second side plates 422A and 422B. Note that an insertion port of the power supply input portion 400 projects to the outside of the first case 42 via a rectangular window hole provided in the first side plate 421B on the first end portion 4001 side.

The power supply unit 4 is mounted to the mounting member 21 of the light source unit 2 such that the bottom plate 420 of the first case 42 is on an upper side, as shown in FIG. 2. Specifically, the second side plate 422B and the fixed plate 423 are respectively screwed to the two side plates 212 of the mounting member 21, and as a result the first case 42 is fixed to the mounting member 21. Also, in a state in which the first case 42 is mounted to the mounting member 21, an opening of the first case 42 is closed by the bottom plate 211 of the mounting member 21.

Figure 7:
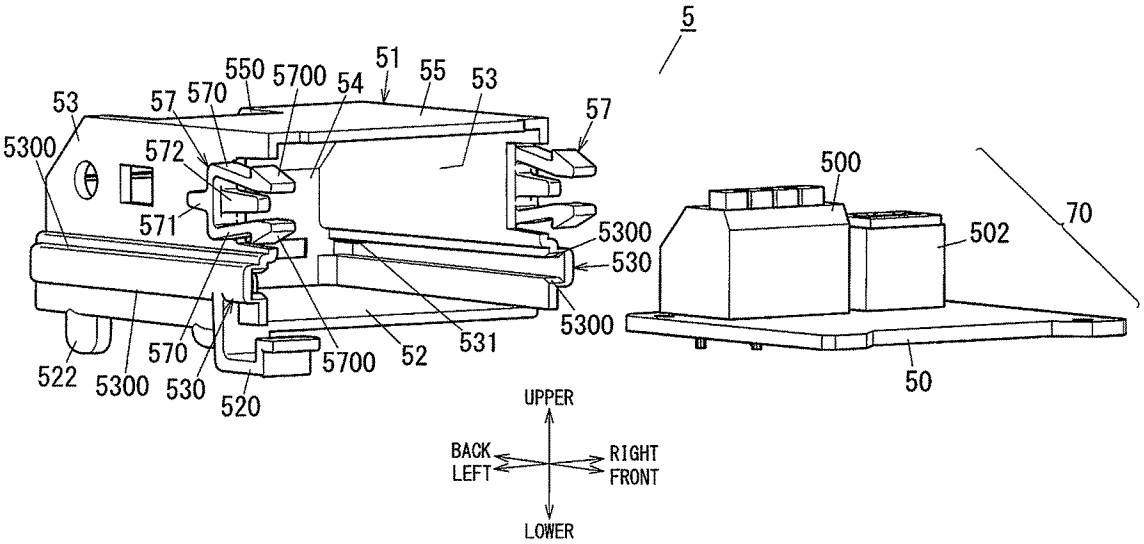
FIG. 7 is an exploded perspective view of the functional unit in Embodiment 1.

The functional unit 5 includes a circuit portion 70 (70A) that includes mounting electronic components on a second print wiring board 50 and a second case 51 that houses the circuit portion 70, as shown in FIG. 7. The circuit diagram of the circuit portion 70 is shown in FIG. 3. The circuit portion 70 includes an external signal input portion 500, a photocoupler 501, resistors R2 and R3, a signal output portion 502, and a signal cable 503.

The external signal input portion 500 includes a conventionally known screwless terminal board, and is electrically connected to a pair of signal lines on which a control signal is transmitted. Also, a series connection of an input terminal (light-emitting diode 501A) of the photocoupler 501 and the current-limiting resistor R2 is electrically connected to the external signal input portion 500. That is, a control signal that is transmitted on the signal lines is inputted to the input terminal of the photocoupler 501 via the external signal input portion 500.

The signal output portion 502 is electrically connected to the signal input portion 410 of the power supply unit 4 via the signal cable 503. The signal cable 503 includes three electric wires (signal lines) 503A to 503C. Ground of the power supply circuit 49 (refer to FIG. 4) is electrically connected, by one electric wire 503A, to an output terminal (emitter of phototransistor 501B) of the photocoupler 501 on the negative electrode side. Also, an output terminal of the controlled power supply circuit 407 is electrically connected to one end of the resistor R3 by another electric wire 503B. Furthermore, a connection point of the other end of the resistor R3 and an output terminal (collector of phototransistor 501B) of the photocoupler 501 on the positive electrode side is electrically connected, by the remaining electric wire 503C, to the light modulation control circuit 408 and the lighting-off control circuit 409. That is, a constant controlled power supply voltage is constantly applied to a series circuit of the resistor R3 and the phototransistor 501B. Therefore, the control signal that is inputted to the light modulation control circuit 408 and the lighting-off control circuit 409 becomes a low level when the input voltage to the photocoupler 501 is a high level, and becomes a high level when the input voltage of the photocoupler 501 is a low level. For example, assume that the control signal (hereinafter referred to as an external control signal) that is inputted to the functional unit 5 from the outside is a pulse width modulation (PWM) signal. In this case, the duty ratio (pulse width) of a control signal (hereinafter referred to as an internal control signal) that is outputted from the functional unit 5 to the power supply unit 4 is a difference between 100% (length of one period) and the duty ratio (pulse width) of the external control signal. For example, the case is assumed where the light modulation level is 100% when the duty ratio of the external control signal is 5%, and the duty ratio of the internal control signal decreases as the light modulation level decreases (becomes dark). In this case, the light modulation control circuit 408 may set the light modulation level to 100% when the duty ratio of the internal control signal is 95%, and decrease the light modulation level as the duty ratio decreases. Also, the lighting-off control circuit 409 may output a lighting-off signal when the duty ratio of the internal control signal is a lower limit value (10%, for example) or less.

Next, the structure of the functional unit 5 will be described in detail with reference to FIGS. 6 to 10. Note that, in the following description, unless otherwise specifically noted, the horizontal, vertical, and front-back directions are defined as in FIG. 7.

Figure 8:
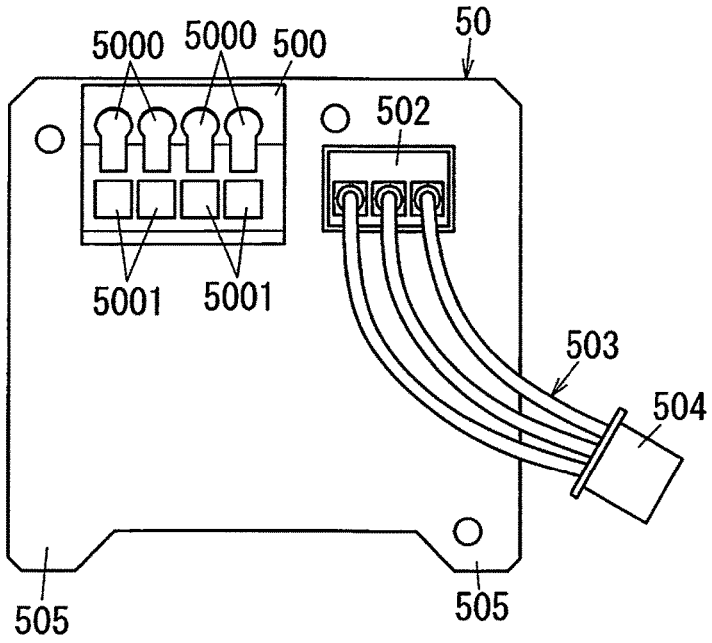
FIG. 8 is a plan view of a second print wiring board in Embodiment 1.

The second print wiring board 50 includes an insulating substrate having a rectangular plate-like shape in which a conductor (copper foil) for wiring is printed on a back surface (lower surface) thereof, as shown in FIG. 8. The external signal input portion 500 and the signal output portion 502 are mounted on a surface (upper surface) of the second print wiring board 50. Components other than the external signal input portion 500 and the signal output portion 502, such as the photocoupler 501 and resistors R2 and R3 are mounted on a back surface (lower surface) of the second print wiring board 50. Here, the external signal input portion 500 is mounted on the second print wiring board 50 on a left side of a back end (upper end in FIG. 8). Four insertion holes 5000 to which respective signal line conductors are to be inserted are provided, in an upper portion of the external signal input portion 500, side by side in a horizontal direction, and four release buttons 5001 are provided side by side in the horizontal direction. That is, since the external signal input portion 500 includes the screwless terminal board, the external signal input portion 500 is configured such that signal line conductors that are inserted into the insertion holes 5000 are electrically connected thereto, and the signal line conductors can be pulled out from the insertion holes 5000 when corresponding release buttons 5001 are pushed.

The signal output portion 502 is mounted on the second print wiring board 50 on a right side of the back end. Also, the plug connector 504 is electrically connected to tips of the signal cables 503 that are led out from the signal output portion 502. Furthermore, protrusions 505 that projects forward are preferably provided on two ends in the horizontal direction at a front end (lower end in FIG. 8) of the second print wiring board 50.

Figure 6:
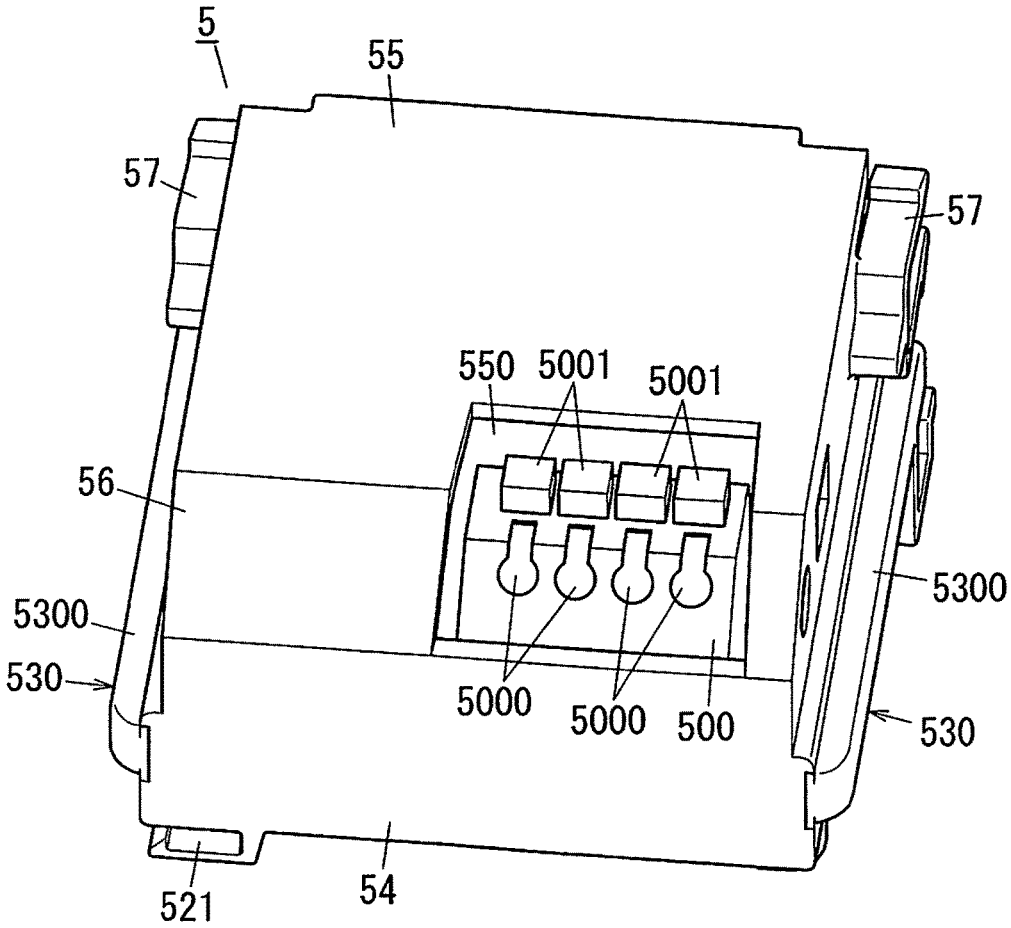
FIG. 6 is a perspective view of the functional unit in Embodiment 1.

The second case 51 includes a lower wall 52, a pair of side walls 53, a back wall 54, an upper wall 55, and an inclined wall 56, and is formed in a box shape in which a front surface is open, as shown in FIGS. 6 and 7. Furthermore, the second case 51 includes a pair of fitting portions 530 into which respective peripheral portions of the second print wiring board 50 are fitted, a pair of holding portions 531 that keep a fitted state between the second print wiring board 50 and the pair of fitting portions 530. Note that the second case 51 is preferably configured as a synthetic resin molded article made of a synthetic resin material such as a polycarbonate resin.

Figure 9:
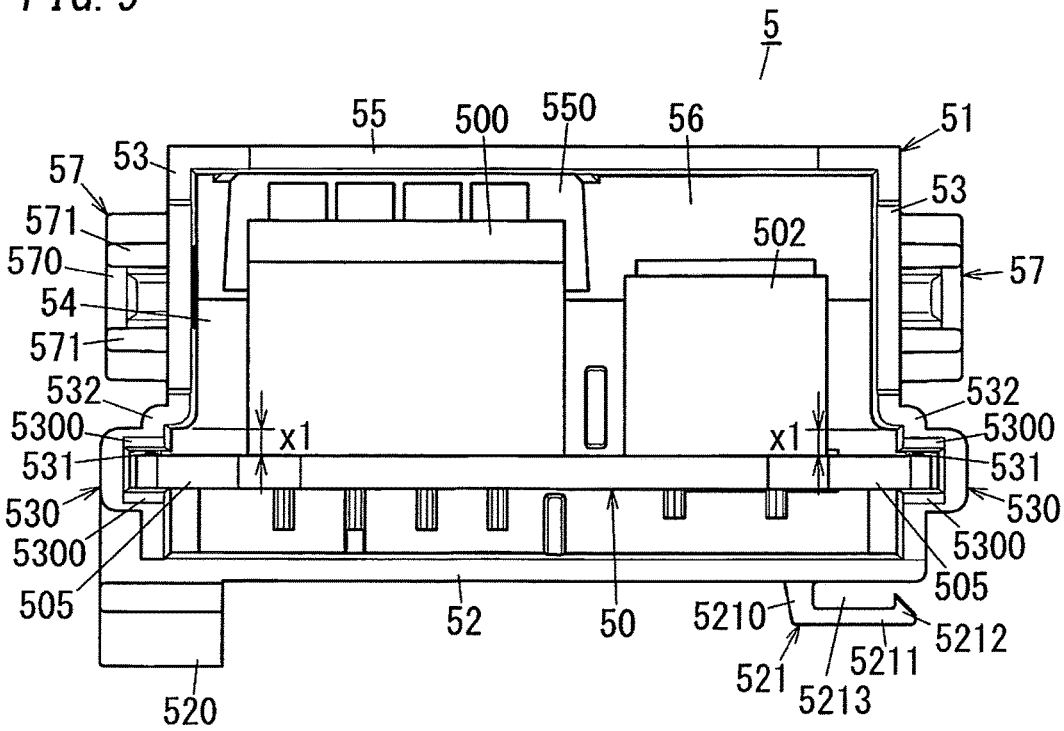
FIG. 9 is a transparent view of the functional unit in Embodiment 1 when viewed from front.

Each fitting portions 530 includes two ribs (a pair of ribs) 5300 that are provided on the side wall 53, as shown in FIG. 7. The two ribs 5300 are formed along a front-back direction so as to project outward from the side wall 53, and oppose each other with a gap therebetween in a vertical direction. A peripheral portion of the second print wiring board 50 is inserted between the two ribs 5300 that are arranged side by side in the vertical direction, as shown in FIG. 9. That is, each fitting portion 530 is configured to sandwich the peripheral portion of the second print wiring board 50 in a thickness direction (vertical direction) by the two ribs 5300 that are arranged side by side in the vertical direction. Note that the distance between the two ribs 5300 is larger than the thickness of the second print wiring board 50.

Figure 10:
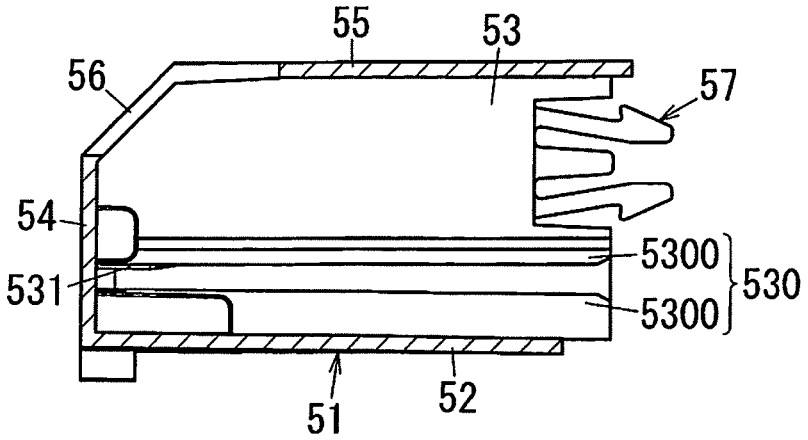
FIG. 10 is a cross-sectional view of a second case of the functional unit in Embodiment 1.

Each holding portion 531 is provided so as to project downward from a lower surface on a back side of an upper side rib 5300, as shown in FIGS. 7, 9, and 10. Each holding portion 531 is preferably formed in a shape in which a triangular pyramid is connected to a tip of a triangular prism. Accordingly, by providing the holding portion 531, a gap (gap between the pair of ribs 5300) on a back end side of the fitting portion 530 decreases. Therefore, each peripheral portion on a back side of the second print wiring board 50 is pressed into a gap between the holding portion 531 and the lower side rib 5300, and the second print wiring board 50 is unlikely to come off from the fitting portion 530. That is, the holding portions 531 are each configured to keep the fitted state between the fitting portion 530 and the second print wiring board 50. Note that, since the tip of each holding portion 531 is formed in a triangular pyramid-like shape, the back ends of the second print wiring board 50 are unlikely to be caught on the front ends of the holding portions 531, when the peripheral portion of the second print wiring board 50 is inserted. Furthermore, front end portions of the two ribs 5300 incline such that the distance therebetween increases gradually toward the front (right in FIG. 10), as shown in FIG. 10. Therefore, the peripheral portions of the second print wiring board 50 are each guided to the front end portions of the ribs 5300, and are smoothly inserted into grooves that are formed between the two ribs 5300.

A rectangular through hole 550 is formed in the second case 51 so as to extend over the upper wall 55 and the inclined wall 56. An upper portion (insertion hole 5000 and release button 5001) of the external signal input portion 500 is exposed to the outside of the second case 51 via the through hole 550 (refer to FIG. 6).

Coupling male portions 57, which form a pair, are provided respectively in front end portions of a pair of side walls 53 of the second case 51, as shown in FIG. 7. The two coupling male portions 57 are mechanically coupled to respective coupling female portions 424, which form a pair, that are provided in a first case 42 of the power supply unit 4. The pair of coupling male portions 57 corresponds to a first mounting mechanism. The pair of coupling female portion 424 corresponds to a second mounting mechanism.

The coupling male portions 57 each include a pair of support pieces 570, a fixed portion 571, and a restriction piece 572, as shown in FIG. 7. The fixed portion 571 is formed in a T-like shape when viewed in a horizontal direction, and is formed integrally with the side wall 53. The two support pieces 570 project forward from two ends of the fixed portion 571 in a vertical direction, and are formed such that the distance therebetween decreases toward the front. A protruding portion 5700 having a triangular prism-like shape that projects outward is provided on the tip of each of the support pieces 570. The restriction piece 572 projects forward from a front end of the fixed portion 571, and is configured to restrict movement of the pair of support pieces 570. That is, when the two support pieces 570 bend so as to approach each other, the bending amount is restricted due to abutting the restriction piece 572.

Here, the second case 51 is preferably configured such that the gap between the two coupling male portions 57 in the horizontal direction is smaller than the width dimension of the second print wiring board 50 in the horizontal direction. Miniaturization of the second case 51 in the horizontal direction can be realized by being configured as described above. In this case, the second case 51 is preferably configured such that gaps X1 are formed between portions that overlap with the coupling male portions 57 when viewed in the thickness direction (vertical direction) of the second print wiring board 50 and the second print wiring board 50 (refer to FIG. 9). Specifically, steps 532 are each preferably formed at a portion in the side wall 53 between the fitting portion 530 and the coupling male portion 57. As described above, when the gap X1 is formed between the side wall 53 of the second case 51 and the second print wiring board 50, a low-height component can be mounted or a wiring conductor can be formed in the peripheral portion of the second print wiring board 50 that corresponds to the gap X1.

On the other hand, the two coupling female portions 424 are preferably configured to oppose the first side plate 421A with a small gap between the coupling female portions 424 and the first side plate 421A, and are each formed in a flat plate-like shape in which a rectangular hole 4240 passes therethrough, as shown in FIG. 5. Note that the coupling female portions 424 are respectively connected to edges of the second side plates 422A and 422B. Also, the first side plate 421A is provided with rectangular holes 4211 that oppose the respective holes 4240 of the coupling female portions 424.

When the pairs of support pieces 570 of the coupling male portions 57 are inserted into the corresponding holes 4240 of the coupling female portions 424, the support pieces 570 of each pair bend inward due to being pushed by two edges of the corresponding hole 4240 in the vertical direction. Then, the protruding portions 5700 ride over the edges of the hole 4240 and are caught on the corresponding coupling female portions 424. As a result, the coupling female portions 424 of the first case 42 are coupled to the corresponding coupling male portions 57 of the second case 51, and the second case 51 is mounted to the first case 42. Note that tips of the coupling male portions 57 enter inside of the first case 42 via the holes 4211.

Furthermore, the second case 51 is preferably provided with a hook portion 520 in a front end portion of the lower wall 52. The hook portion 520 is formed in a J-like shape when viewed in the horizontal direction, as shown in FIG. 7. The hook portion 520 is hooked to a front end of the first side plate 421A of the first case 42, as show in FIG. 4.

Also, the second case 51 is preferably provided with a cable holding portion 521 in a front end portion of the lower wall 52. The cable holding portion 521 includes a pole portion 5210 that projects downward from a lower surface of the lower wall 52 and a beam portion 5211 that projects from a tip (lower end) of the pole portion 5210 approximately in parallel to the lower surface of the lower wall 52, and is formed in an L shape when viewed in a front-back direction, as shown in FIG. 9. Also, a triangular prism-like protrusion (barb) 5212 that projects toward the lower wall 52 is provided at a tip of the beam portion 5211. That is, in the cable holding portion 521, the output lines 43 are inserted into a gap 5213 between the lower wall 52 and the beam portion 5211, and the output lines 43 are held by the protrusion 5212 so as not to move out from the gap 5213, as shown in FIGS. 4 and 9.

Furthermore, the second case 51 is provided with two projecting portions 522 that project downward from a back end portion of the lower wall 52. Note that the tips (lower ends) of the projecting portions 522 are preferably formed in a hemispherical shape.

Next, a procedure for assembling the power supply device A2 with the power supply unit 4 and the functional unit 5 will be described. Note that the functional unit 5 is not an essential constituent element of the power supply device A2, and the power supply device A2 may include only the power supply unit 4.

Figure 11:
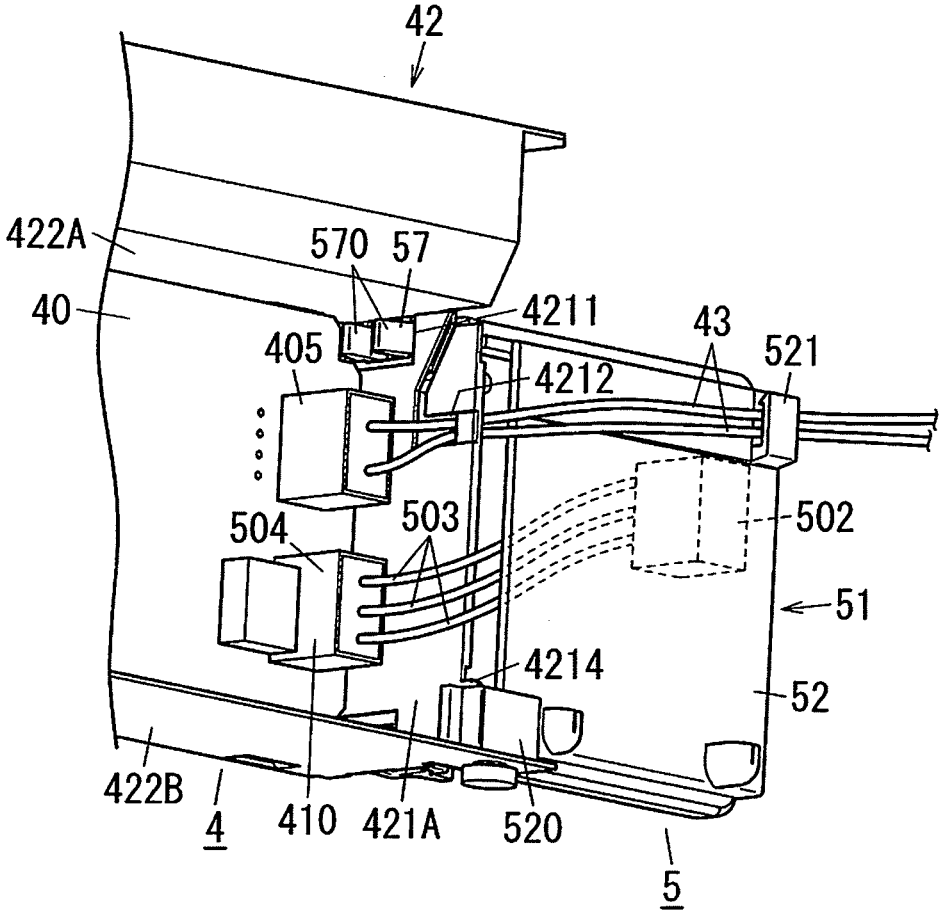
FIG. 11 is a perspective view illustrating main parts of the power supply unit and the functional unit in Embodiment 1.

First, after electrically connecting one end of each of the output lines 43 to the power supply output portion 405 of the power supply unit 4, an operator inserts the output lines 43 to a holding groove 4212 provided in the first side plate 421A to cause the output lines 43 to be held, as shown in FIG. 11. Furthermore, the operator causes the output lines 43 to be held by the cable holding portion 521 of the second case 51 of the functional unit 5. Next, the operator plugs the plug connector 504 of the functional unit 5 into the signal input portion 410 of the power supply unit 4. Furthermore, the operator, after hooking the hook portion 520 to a leading end of the first side plate 421A of the first case 42, inserts the pairs of support pieces 570 of the coupling male portion 57 into the respective holes 4240 of the corresponding coupling female portions 424 (refer to FIG. 5), and couples the coupling male portions 57 with respective coupling female portions 424. With the above procedure, the functional unit 5 is mounted to the power supply unit 4, and the assembly of the power supply device A2 is completed.

Figure 12:
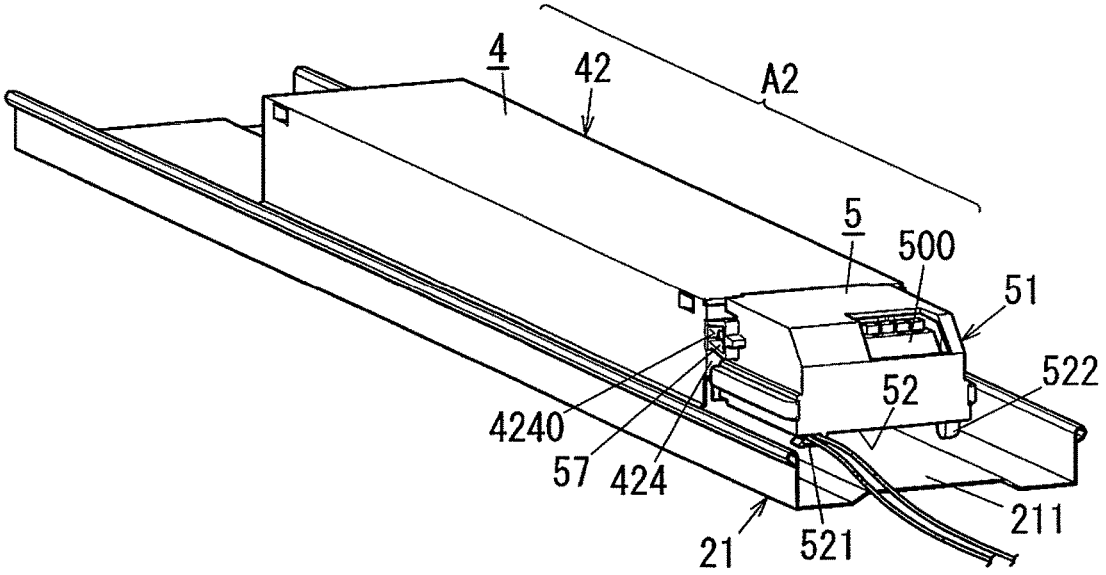
FIG. 12 is a perspective view illustrating the power supply unit and the functional unit in Embodiment 1.

Next, the procedure for assembling the light source unit 2 will be described. The operator mounts the power supply device A2 (power supply unit 4 and functional unit 5) that is assembled by the above procedure on the mounting member 21 on an upper surface side, and fixes the LED module 22 to the lower surface of the bottom plate 211 of the mounting member 21, as shown in FIGS. 2 and 12. At this time, because tips of the two projecting portions 522 provided in the lower wall 52 of the second case 51 abut to the bottom plate 211 of the mounting member 21, a gap is formed between the lower wall 52 of the second case 51 and the bottom plate 211. Then, the output lines 43 (refer to FIG. 11) are wired into the gap. Next, the operator inserts the output lines 43 of the power supply unit 4 into a hole provided in the bottom plate 211 of the mounting member 21, and plugs the plug connector provided at the tips of the output lines 43 into a connector (receptacle connector) provided at an end portion of the LED module 22.

Finally, the operator mounts the cover 23 to the mounting member 21 in a state in which the opening side of the mounting member 21 is on an upper side. At this time, the two protruding portions 233A provided respectively in the two protruding wall portions 233 of the cover 23 are caught on the corresponding inclined portions 212A of the side plate 212 of the mounting member 21, and as a result the cover 23 is mounted on the mounting member 21. The light source unit 2 is assembled by the procedure described above.

Next, the installation procedure of the lighting fixture A1 of the present embodiment will be described. First, an installer inserts the power supply line 30 and the signal line that are wired in advance on a back side of the ceiling into the hole 111A of the fixture body 1, and furthermore inserts the hanging bolts 200 that expose on a room side into the corresponding holes 111B, as shown in FIG. 1. Thereafter, the installer screws nuts 300 to the respective hanging bolts 200, and fixes the fixture body 1 to the ceiling 100. Thereafter, the installer connects the power supply line 30 to the terminal board 25, and furthermore plugs the plug connector 251 of the terminal board 25 into the power supply input portion 400 (refer to FIG. 4) of the power supply unit 4. Next, the installer connects the signal line to the external signal input portion 500 (refer to FIG. 6) of the functional unit 5.

Then finally, the installer, after hooking the tips of the two hooking metal fittings 214 to respective insertion holes 112A provided in one side plate 112 of the fixture body 1, hooks the two hooking springs 215 to respective hook portions 1120 provided in the other side plate 112 of the fixture body 1. Then, when the installer pivots the light source unit 2 so as to lift the light source unit 2 using the hooking metal fittings 214 as a fulcrum, as a result of the hooking springs 215 returning to the original state while being hooked to the hook portions 1120, the light source unit 2 is held by the fixture body 1 due to the spring force of the hooking springs 215. The lighting fixture A1 is installed to the ceiling 100 by the procedure described above.

Here, as described in the conventional example, a spatial distance regulated by law (Electrical Appliances and Materials Safety Act, in Japan) between the power supply input portion 400 and the signal input portion 410 needs to be secured. Therefore, in the case where the signal input portion 410 is arranged in the vicinity of the power supply input portion 400 (first end portion 4001 of first print wiring board 40), the size of the first print wiring board 40 in the short direction (width direction) necessarily increases in order to secure the spatial distance. However, in the Electrical Appliances and Materials Safety Act, the regulation regarding the spatial distance between the rectification portion 402 and the signal input portion 410 is allowed so as to be shorter than the spatial distance, which is regulated by the law, between the power supply input portion 400 and the signal input portion 410 if the device passes a predetermined test. Therefore, when the signal input portion 410 is mounted at a position closer to the second end portion 4002 than the rectification portion 402, in the first print wiring board 40, the width dimension (size in the short direction) of the first print wiring board 40 can be reduced.

As described above, the power supply device A2 according to the present embodiment includes the power supply unit 4. The power supply unit 4 includes: the power supply input portion 400 configured to receive an AC voltage (AC current) from the outside of the supply unit 4; the rectification portion 402 configured to rectify the AC voltage (AC current) that is received by the power supply input portion 400; and the smoothing portion (step up circuit 403) configured to smooth the pulsating voltage (pulsating current) that is outputted from the rectification portion 402. Also, the power supply unit 4 includes the power conversion portion (step down circuit 404) configured to convert, to the second DC voltage (second DC current), the first DC voltage (first DC current) that is outputted from the smoothing portion. Furthermore, the power supply unit 4 includes: the power supply output portion 405 configured to output, to the outside, the second DC voltage (second DC current) that is converted in the power conversion portion; and the signal input portion 410 configured to receive a control signal from the outside. Furthermore, the power supply unit 4 includes the control portion (main control circuit 406, light modulation control circuit 408, lighting-off control circuit 409), the circuit substrate (first print wiring board 40), and the case (first case) 42. The control portion is configured to control the power conversion portion to change the magnitude of the second DC voltage (second DC current), which is to be outputted from the power supply output portion 405 to the outside, based on the control signal that is inputted to the signal input portion 410. The power supply input portion 400, the rectification portion 402, the smoothing portion, the power conversion portion, the power supply output portion 405, the signal input portion 410, and the control portion are mounted on the circuit substrate. The case houses the circuit substrate. The circuit substrate is formed in the elongated rectangular plate-like shape. Furthermore, the power supply input portion 400 is mounted on the first end portion 4001 of the circuit substrate in the longitudinal direction B11. The rectification portion 402, the smoothing portion, the power conversion portion, the control portion, and the power supply output portion 405 are mounted on the circuit substrate in the stated order from the first end portion 4001 toward the second end portion 4002 in the longitudinal direction B11. Also, the signal input portion 410 is mounted at a position closer to the second end portion 4002 than the rectification portion 402 in the circuit substrate.

Also, the illumination device (lighting fixture A1) of the present embodiment includes the power supply device A2 and the illumination load A3 (LED module 22) that is lighted by the second DC voltage (second DC current) supplied by the power supply device A2.

Since the power supply device A2 (power supply unit 4) of the present embodiment is configured as described above, the width dimension of the circuit substrate (first print wiring board 40) can be reduced compared with the case where the signal input portion is arranged in the vicinity of the power supply input portion. As a result, the power supply device A2 (power supply unit 4) of the present embodiment can be miniaturized while securing the spatial distance between the power supply input portion 400 and the signal input portion 410 compared with the conventional example. Also, the illumination device (lighting fixture A1) of the present embodiment can be miniaturized following the miniaturization of the power supply device A2 (power supply unit 4).

Also, the power supply unit 4 of the present embodiment has an advantage in that, even if the size thereof is reduced, harmonic noise is unlikely to be induced or transmitted to the signal input portion 410 because the signal input portion 410 is arranged in the vicinity of the smoothing capacitor C2 or the power supply output portion 405 that constitutes the step down circuit 404.

Furthermore, the power supply device A2 of the present embodiment preferably includes the functional unit 5 that is electrically connected to the power supply unit 4 via the signal input portion 410. The functional unit 5 is preferably configured to generate the control signal, and to output the control signal to the signal input portion 410. The power supply unit 4 preferably includes the power supply portion (controlled power supply circuit 407) for supplying electric power for operation to the functional unit 5.

When the power supply device A2 is configured as described above, a new function (functional unit 5) can be added to the power supply unit 4 in a later stage, and usability can be improved. Furthermore, the functional unit 5 does not require a power supply circuit because the electric power for operation is supplied from the power supply portion (controlled power supply circuit 407) of the power supply unit 4, resulting in simplification and miniaturization in circuit configuration.

Also, in the power supply device A2 of the present embodiment, it is preferable that the case is the first case 42, and the functional unit 5 includes the second case 51 and the first mounting mechanism (coupling male portion 57) that enables the second case 51 to be mechanically mounted to the first case 42. The power supply unit 4 preferably includes the second mounting mechanism (coupling female portion 424) that is to be coupled to the first mounting mechanism and enables the second case 51 to be mechanically mounted to the first case 42.

Note that the circuit portion 70 of the functional unit 5 may be configured to convert an external control signal constituted by a DC voltage having a voltage level corresponding to the light modulation level to a PWM light modulation signal having a duty ratio corresponding to the light modulation level, and output the converted signal. Furthermore, when two or more types of functional units 5 are prepared, which each convert a different type of control signal (PWM light modulation signal or DC signal) to a common control signal (PWM light modulation signal), various control signals can be handled only by replacing the functional unit 5 that is combined with the power supply unit 4.

Figure 13:
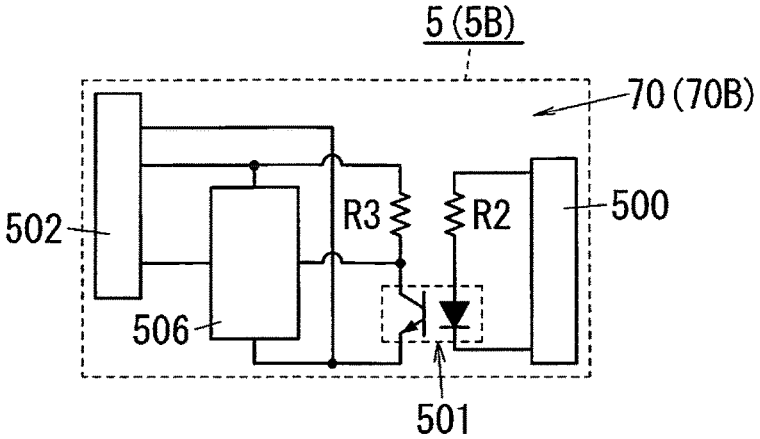
FIG. 13 is a circuit diagram of another functional unit in Embodiment 1.

The circuit portion 70 (70B) of another functional unit 5 (5B) is shown in FIG. 13. In the circuit portion 70B of the functional unit 5B, a signal conversion portion 506, which performs signal conversion on an external control signal, is added to the circuit portion 70 (70A) (refer to FIG. 3) of the functional unit 5 (5A) shown in FIG. 3. That is, the circuit portion 70B of the functional unit 5B includes the signal conversion portion 506. The signal conversion portion 506 includes a microcontroller as the main constituent element, and is configured to perform later described signal conversion by executing a program stored in an embedded memory of the microcontroller with the microcontroller. Note that the signal conversion portion 506 outputs a control signal (internal control signal) after the signal conversion from the signal output portion 502 to the power supply unit 4 (refer to FIG. 3).

Next, the signal conversion processing of the signal conversion portion 506 will be described in detail with reference to FIG. 14. Note that the horizontal axis in FIG. 14 shows the duty ratio of the external control signal (PWM light modulation signal), and the vertical axis shows the duty ratio of the internal control signal (PWM light modulation signal)

Figure 14:
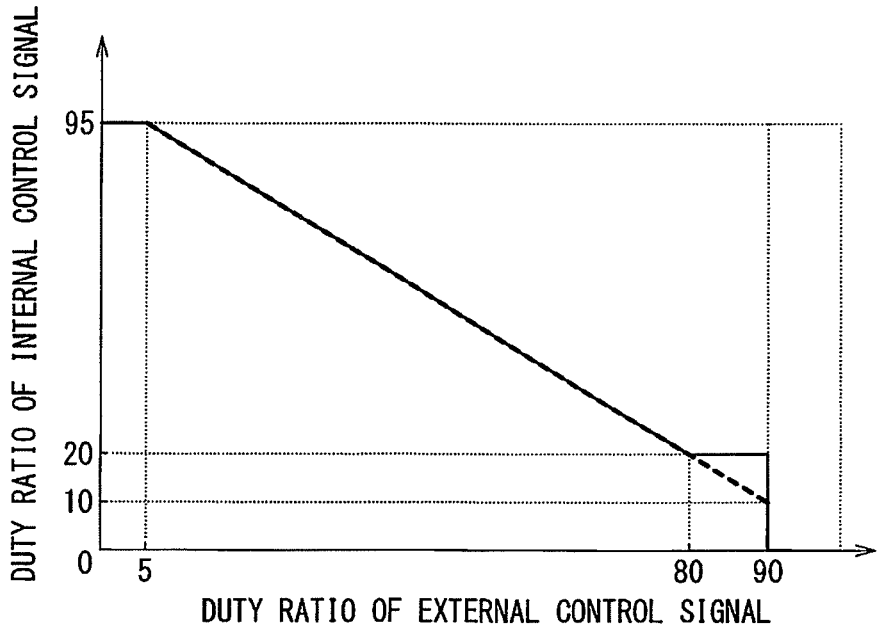
FIG. 14 is a diagram for describing an operation of the functional unit in Embodiment 1.

As shown by the broken line in FIG. 14, the external control signal is set such that the duty ratio thereof is 5% when the light modulation level is 100%, and the duty ratio linearly decreases as the light modulation level decreases, and the duty ratio is 90% when the light modulation level is a lower limit value. Note that the upper limit of the duty ratio of the external control signal is 90%.

In contrast, as shown by the solid line in FIG. 14, the internal control signal is set such that the duty ratio thereof is 95% when the duty ratio of the external control signal is 5%, and the duty ratio is fixed to 20% when the duty ratio of the external control signal is in a range from 80% to 90%.

That is to say, the signal conversion portion 506 is configured to perform signal conversion such that the lower limit value of the light modulation level designated by the internal control signal is higher (brighter) than the lower limit value of the light modulation level designated by the external control signal.

The purpose of performing light modulation on the lighting fixture A1 is mainly for giving dramatic impact and energy saving. Furthermore, even in a case where the energy saving is the purpose, there are cases where the energy saving is desired to be increased by decreasing the lower limit value of the light modulation level and where the lower limit value of the light modulation level is desired not to be excessively decreased considering security control or the like. In the latter case, by using the above described functional unit 5B, the lower limit value of the light modulation level of the lighting fixture A1 can be changed to a value that is higher than the lower limit value of the light modulation level designated by the external control signal.

Figure 15:
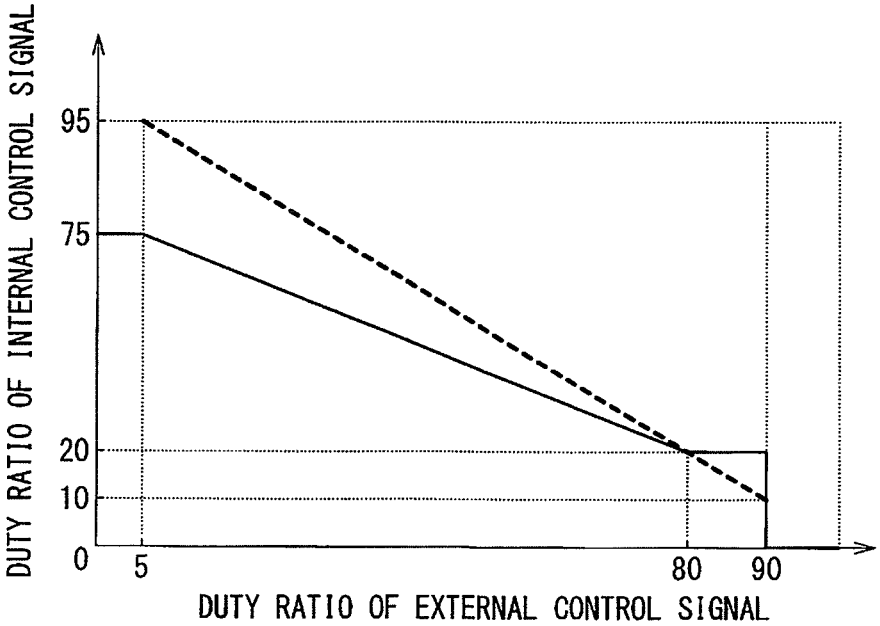
FIG. 15 is a diagram for describing another operation of the functional unit in Embodiment 1.

Furthermore, the signal conversion portion 506 may be configured to perform signal conversion such that, as shown by the solid line in FIG. 15, the upper limit value of the light modulation level designated by the internal control signal is lower (darker) than the upper limit value of the light modulation level designated by the external control signal. In this case, energy saving can be further increased by changing the upper limit value of the light modulation level of the lighting fixture A1 to a value that is smaller than the upper limit value of the light modulation level designated by the external control signal by using the functional unit 5B.

Figure 16:
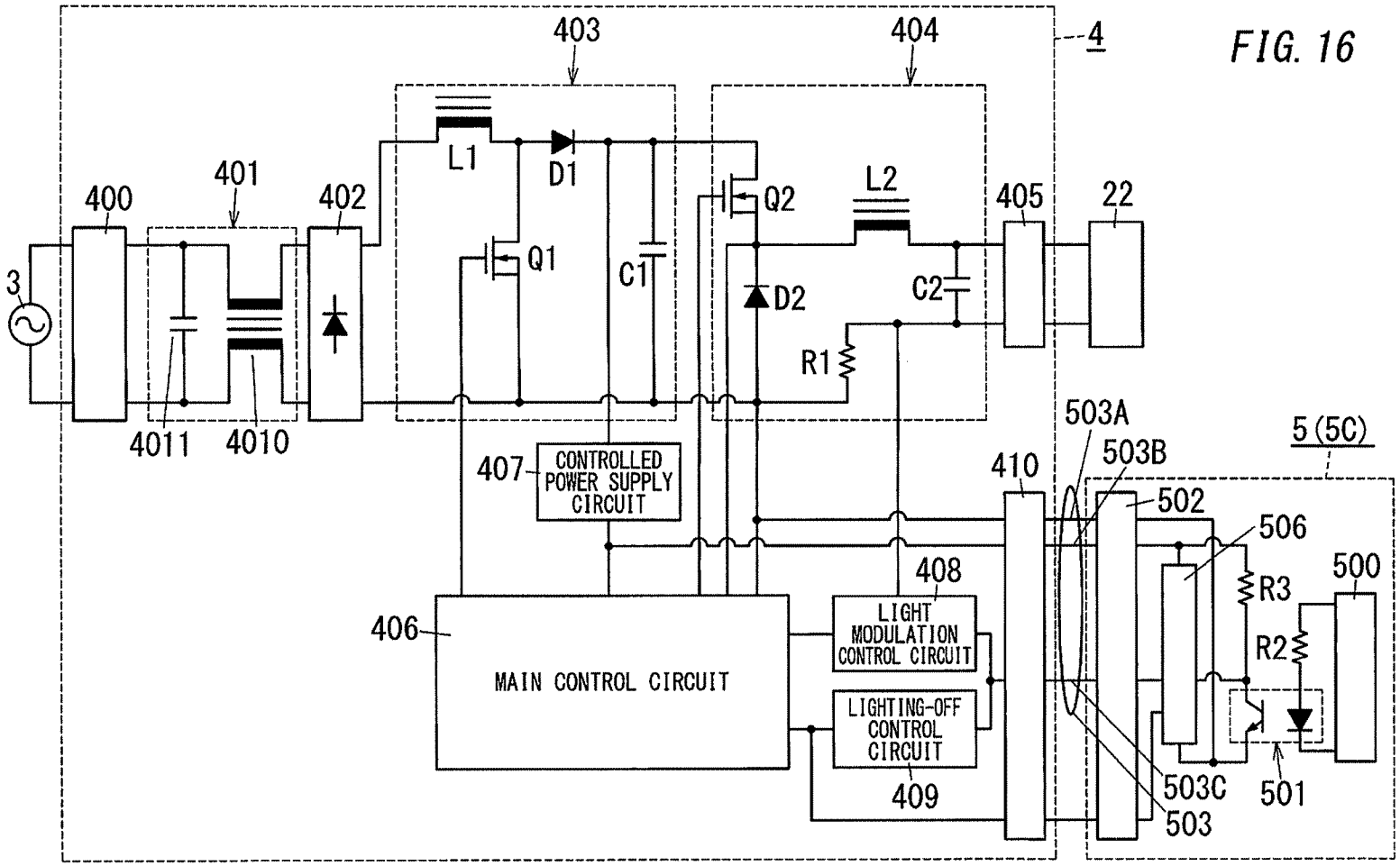
FIG. 16 is another circuit diagram of the power supply unit and the functional unit in Embodiment 1.

Also, the functional unit 5 (5C) is preferably configured such that the lighting-off signal that is outputted from the lighting-off control circuit 409 of the power supply unit 4 to the main control circuit 406 is fed back to the signal conversion portion 506 via the signal input portion 410 and the signal output portion 502, as shown in FIG. 16. Furthermore, upon receiving the lighting-off signal, the signal conversion portion 506 of the functional unit 5C preferably puts the microcontroller in a sleep state or relatively decreases the frequency of a clock signal supplied to the microcontroller. When the functional unit 5C is configured as described above, electric power consumed in the signal conversion portion 506 while the light source (LED module 22) is turned off can be decreased. Note that, upon receiving a new external control signal for example, the signal conversion portion 506 preferably causes a return from the low power consumption mode (standby mode) to a normal operation mode.

Figure 17:
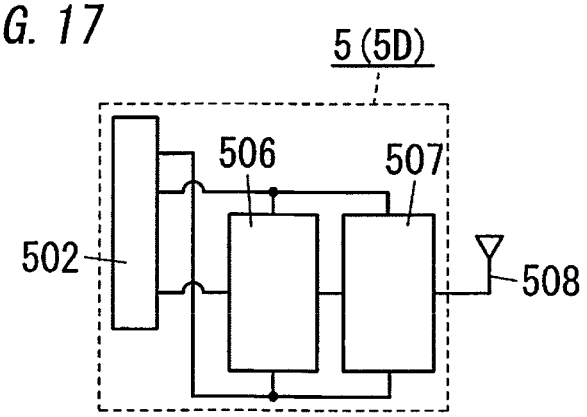
FIG. 17 is a circuit diagram of another functional unit in Embodiment 1.

Incidentally, an external control signal may be wirelessly transmitted by using a radio wave as a medium. Therefore, a functional unit 5 (5D) preferably includes: an antenna 508 for catching (receiving) a radio wave; and a wireless communication circuit 507 configured to receive the external control signal via the antenna 508, as shown in FIG. 17. The wireless communication circuit 507 preferably includes a commercially available radio module for telecontrol of a specified low power radio station. Such a wireless communication circuit 507 is preferably configured to acquire the external control signal by demodulating and decoding an electric signal (reception signal) received from the antenna 508, and to send the acquired external control signal to the signal conversion portion 506. Then, the signal conversion portion 506 performs the above described signal conversion and outputs the internal control signal resulting from the signal conversion to the power supply unit 4 via the signal output portion 502. Note that the antenna 508 may be mounted on the second print wiring board 50 and housed in the second case 51, or may be arranged outside the second case 51.

When combined with the power supply unit 4, the functional unit 5D configured as described above has an advantage that a work for wiring a signal line to the lighting fixture A1 becomes unnecessary. Also, since the wiring work of the signal line is unnecessary, a remote control function can be easily added by adding the functional unit 5D to the lighting fixture A1 after installation. As a result, a new function (wireless remote control function) can be easily added to the lighting fixture A1 at low cost without replacing the lighting fixture A1.

Also, the functional unit 5 may be configured such that an initial illumination correction function is added to the power supply unit 4. The initial illumination correction function is a function for adjusting the light modulation level corresponding to the accumulated lighting time such that the light output can be kept at approximately constant (85% of rated value, for example) from the start of usage to the end of life of the light source (LED module 22).

Figure 18:
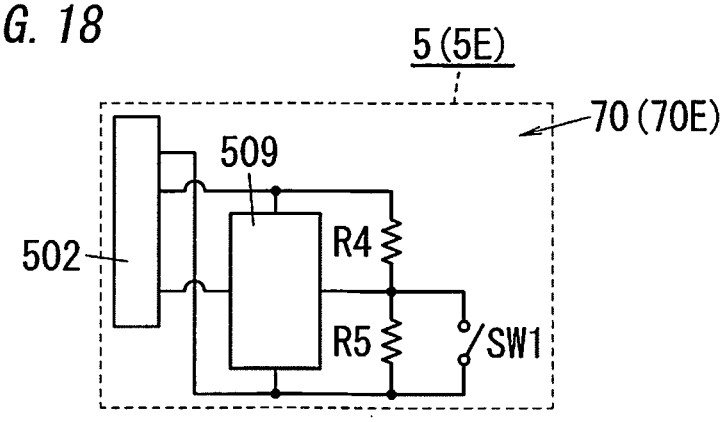
FIG. 18 is a circuit diagram of yet another functional unit in Embodiment 1.

The circuit configuration of a circuit portion 70 (70E) of a functional unit 5 (5E) for realizing the initial illumination correction function is shown in FIG. 18. The circuit portion 70E includes a signal processing portion 509, a signal output portion 502, voltage-dividing resistors R4 and R5, and a switch SW1. The signal processing portion 509 includes a microcontroller as the main constituent element, and is configured to perform signal processing for initial illumination correction by executing a program stored in an embedded memory of the microcontroller with the microcontroller. Note that the signal processing portion 509 outputs the internal control signal generated by the signal processing from the signal output portion 502 to the power supply unit 4 (refer to FIG. 3). The voltage-dividing resistors R4 and R5 are electrically connected in series. The voltage-dividing resistors R4 and R5 are respectively connected to two electric wires (signal lines) 503B and 503A (refer to FIG. 3) of the signal cable 503. The voltage-dividing resistors R4 and R5 are configured to divide the controlled power supply voltage supplied from the controlled power supply circuit 407 of the power supply unit 4. Also, a connection point of the voltage-dividing resistors R4 and R5 is electrically connected to an input port (input port of microcontroller) of the signal processing portion 509. Furthermore, the switch SW1 is electrically connected in parallel to the voltage-dividing resistor R5. That is, when the controlled power supply voltage is supplied, the input port of the signal processing portion 509 receives a signal that is in a high level when the switch SW1 is off and in a low level when the switch SW1 is on.

Figure 19:
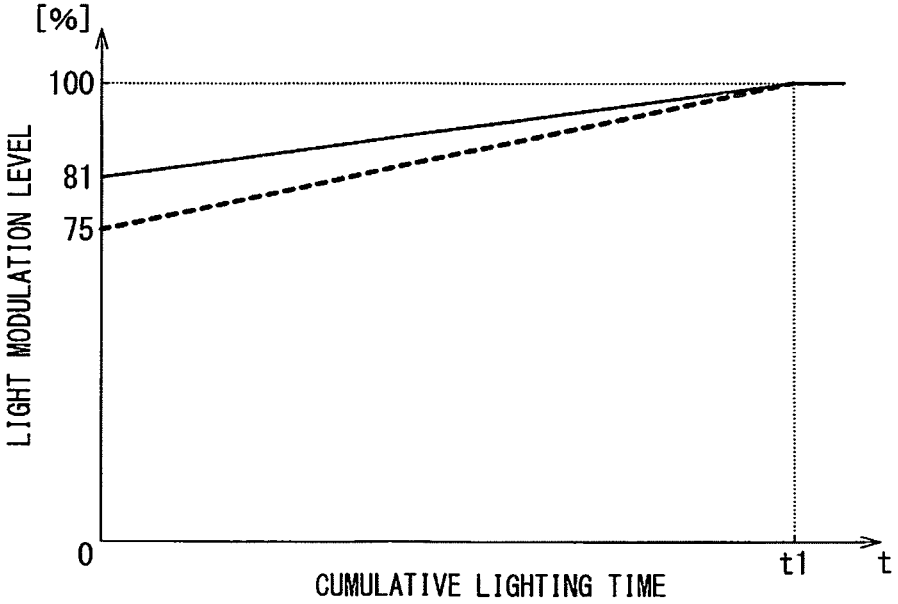
FIG. 19 is a diagram for describing an operation of the functional unit in Embodiment 1.

The signal processing portion 509 operates by the controlled power supply voltage being supplied from the power supply unit 4 due to application of the AC power supply 3. The signal processing portion 509 measures a time length during which the controlled power supply voltage is supplied (time length during which the microcontroller operates), stores the measured time length in the embedded memory, and regards the cumulative value of the time lengths as the cumulative lighting time of the light source (LED module 22). Here, illuminance correction characteristics shown by the solid line and the broken line in FIG. 19 are stored in the embedded memory of the microcontroller that constitutes the signal processing portion 509. The illuminance correction characteristics represent a relationship between the cumulative lighting time t (horizontal axis) and the light modulation level (vertical axis), the initial value of the light modulation level when the cumulative lighting time t=0 is set to a value smaller than 100%, and the light modulation level is set to gradually increase in proportion to the cumulative lighting time. Note that the illuminance correction characteristics are set such that the light modulation level is 100% when the cumulative lighting time t reaches a pre-set life time t1.

For each predetermined time (several minutes to several hours, for example), the signal processing portion 509, determines the light modulation level corresponding to the cumulative lighting time from the illuminance correction characteristic, generates the internal control signal that designates the determined light modulation level, and outputs the internal control signal from the signal output portion 502 to the power supply unit 4. Here, the signal processing portion 509 preferably determines the light modulation level from the illuminance correction characteristic shown by the solid line in FIG. 19 when the input signal to the input port is in a low level, and determines the light modulation level from the illuminance correction characteristics shown by the broken line in FIG. 19 when the input signal to the input port is at a high level. That is, it is preferable that, when the light flux decay rate (reduction amount of light flux per unit time) of the light source (LED module 22) is high, the switch SW1 is turned off, and the illuminance correction characteristic shown by the broken line is selected, and when the light flux decay rate is low, the switch SW1 is turned on, and the illuminance correction characteristic shown by the solid line is selected. Note that the turning on and off of the switch SW1 is preferably performed by a user or an installer.

When the functional unit 5E configured as described above is combined with the power supply unit 4, the initial illumination correction function can easily be added. Note that the functional unit 5E is preferably configured such that, by including a plurality of switches, one kind of illuminance correction characteristic can be selected from three or more kinds of illuminance correction characteristics.

Embodiment 2

Figure 20:
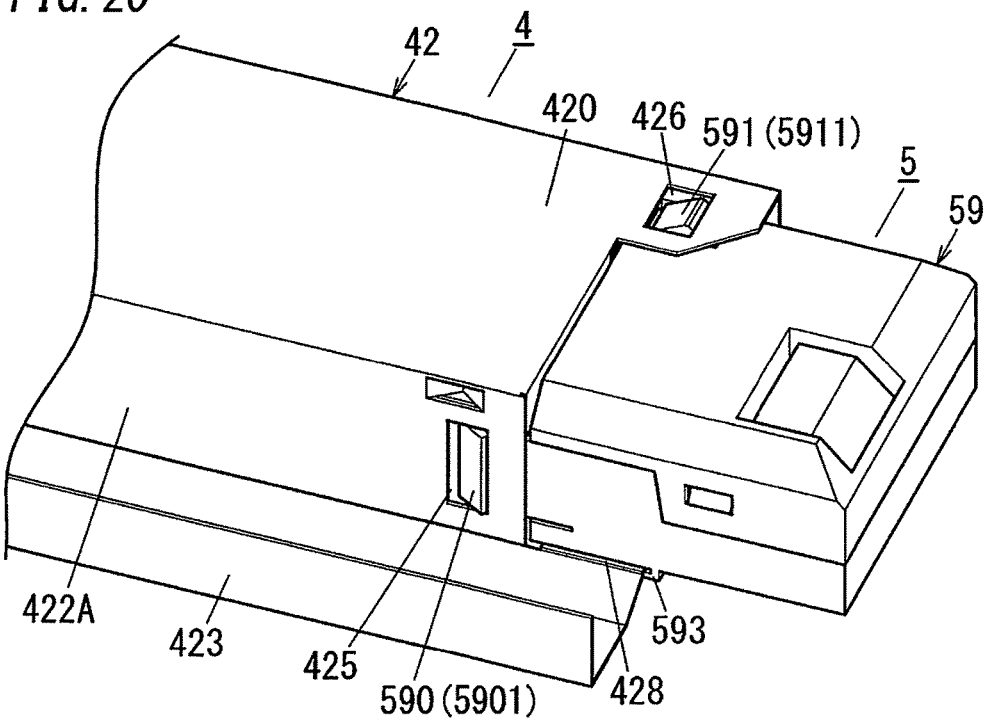
FIG. 20 is a partial perspective view of a power supply device according to Embodiment 2.

A power supply device A2 according to Embodiment 2 will be described in detail with reference to FIGS. 20 to 22. Note that the power supply device A2 of the present embodiment is characterized by a mounting structure for mounting a second case 59 of the functional unit 5 to the first case 42 of the power supply unit 4, and the other configurations are basically in common with the power supply device A2 of Embodiment 1. Accordingly, constituent elements in common with the power supply device A2 of Embodiment 1 are provided with the same reference numerals, and illustration and description thereof will be omitted as appropriate.

Figure 21:
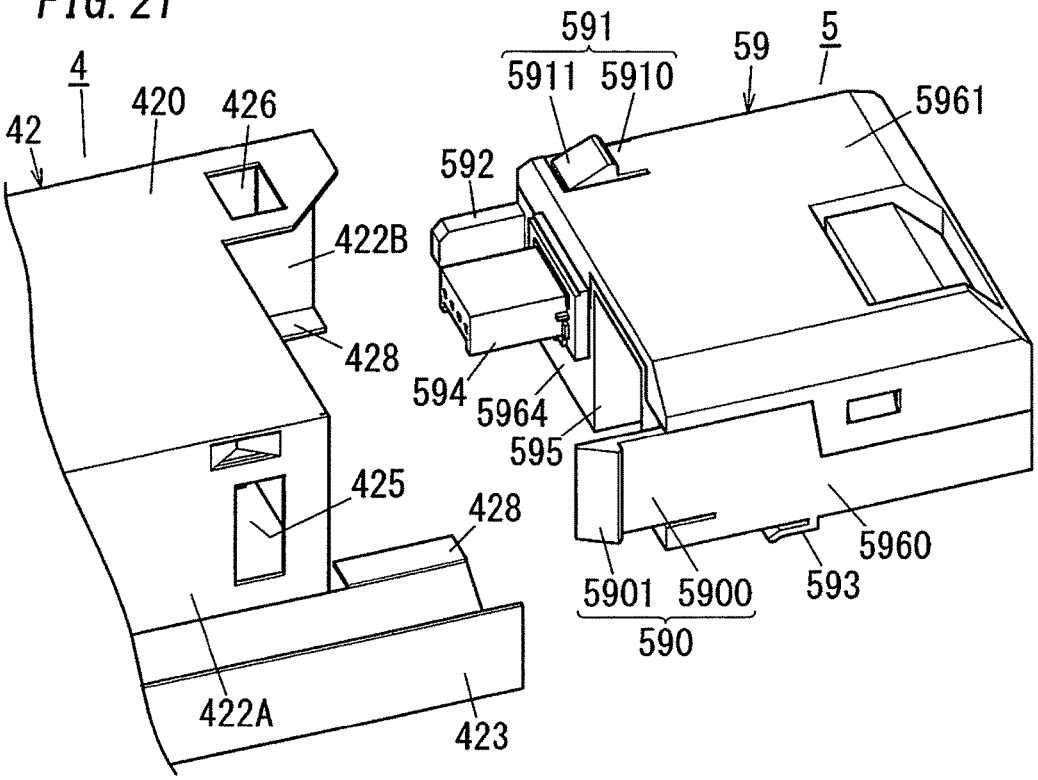
FIG. 21 is a partial exploded perspective view of the power supply device according to Embodiment 2.
Figure 22:
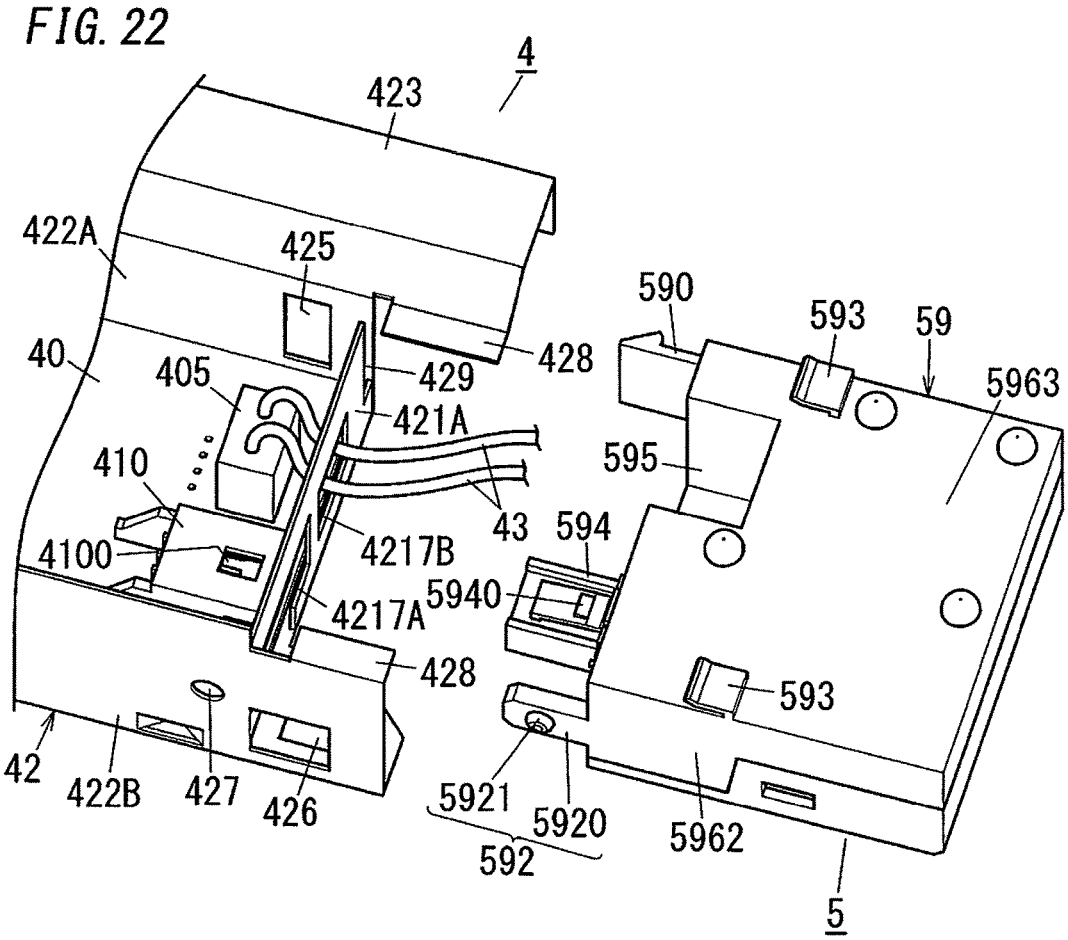
FIG. 22 is a partial exploded perspective view of the power supply device according to Embodiment 2.

The second case 59 in the present embodiment includes three coupling male portions 590, 591, and 592, as shown in FIGS. 21 and 22. The first coupling male portion 590 includes: a support piece 5900 that has a rectangular shape and projects backward from a back end of a left side wall 5960 of the second case 59; and a protruding portion 5901 shaped like a triangular prism provided at a tip (back end) of the support piece 5900. The second coupling male portion 591 includes: a bending piece 5910 provided in a back end portion of an upper wall 5961 of the second case 59; and a protruding portion 5911 shaped like a triangular prism that projects upward from a back end upper surface of the bending piece 5910. The third coupling male portion 592 includes: a support piece 5920 shaped like a rectangular plate that projects backward from a back end of a right side wall 5962 of the second case 59; and a hemispherical protruding portion 5921 that projects outward from a side surface of the support piece 5920. The first to third coupling male portions 590 to 592 correspond to a first mounting mechanism.

Furthermore, the second case 59 is provided with a pair of hook portions 593 that are respectively arranged on left and right ends of a lower wall 5963 (refer to FIG. 22). The hook portions 593 are formed in L shapes so as to have gaps between the lower wall 5963 and the hook portion 593.

A plug connector 594 corresponding to a signal output portion is provided in a back wall 5964 of the second case 59 so as to project backward. Contacts of the plug connector 594 are through-hole mounted to a second print wiring board 50. A claw 5940 for locking is provided in a housing of the plug connector 594. Furthermore, a recessed portion 595 is provided extending across the back wall 5964 and the lower wall 5963 of the second case 59.

On the other hand, a first case 42 in the present embodiment includes three coupling female portions 425, 426, and 427. The first coupling female portion 425 is constituted by a rectangular through hole provided in a second side plate 422A. The second coupling female portion 426 is constituted by a rectangular through hole provided in a bottom plate 420. The third coupling female portion 427 is constituted by a circular through hole provided in a second side plate 422B. The first to third coupling female portions 425 to 427 correspond to a second mounting mechanism.

Furthermore, the first case 42 includes hooking pieces 428 that project inward respectively from a lower side of a fixed plate 423 and a lower side on a first end portion 4001 side of the second side plate 422B. Also, through holes 429 (only one is shown in FIG. 22) are provided in left and right ends of a first side plate 421A of the first case 42.

In the power supply device A2 of the present embodiment, a signal input portion 410 is configured such that the plug connector 594 of the functional unit 5 can be plugged thereinto in a manner of being freely inserted and pulled out in a front-back direction. That is, rectangular through holes 4217A and 4217B are provided in the first side plate 421A side by side in the horizontal direction, and the plug connector 594 that is inserted into the left through hole 4217A is plugged into the signal input portion 410. Also, a hole 4100 by which the claw 5940 of the plug connector 594 is caught is provided in a housing of the signal input portion 410. That is, when the plug connector 594 is plugged into the signal input portion 410, the plug connector 594 is prevented from unintentionally coming out from the signal input portion 410 as a result of the claw 5940 being caught by the hole 4100 (edge thereof). Note that the claw 5940 is configured so as to be bendable relative to the housing of the plug connector 594. Accordingly, when the engagement with the hole 4100 is released by bending the claw 5940 toward the housing, the plug connector 594 can be pulled out from the signal input portion 410. Note that output lines 43 are inserted into the right through hole 4217B.

Next, the procedure for assembling the power supply device A2 will be described. First, an operator inserts, after inserting the output lines 43 of the power supply unit 4 into the recessed portion 595, the first coupling male portion 590 and the third coupling male portion 592 respectively into the right and left through holes 429 of the first side plate 421A, as shown in FIGS. 21 and 22. At this time, the operator inserts the plug connector 594 of the functional unit 5 into the through hole 4217A of the first side plate 421A. When the operator brings the second case 59 close to the first case 42, the first coupling male portion 590 to the third coupling male portion 592 are respectively coupled to the first coupling female portion 425 to the third coupling female portion 427, and the plug connector 594 is plugged into the signal input portion 410. As a result, the power supply unit 4 and the functional unit 5 are mechanically coupled and are also electrically connected (refer to FIG. 20). Note that the two hooking pieces 428 of the first case 42 are respectively inserted into the gaps between the two hook portions 593 and the lower wall 5963 of the second case 59.

The power supply device A2 of the present embodiment has an advantage that the second case 59 can be strongly mounted to the first case 42 compared with the power supply device A2 of Embodiment 1. Also, the functional unit 5 in the present embodiment also has an advantage that the mounting operation of the second case 59 to the first case 42 is easily performed because the signal cable 503 is unnecessary. Note that, when the plug connector 594 of the functional unit 5 is plugged into the signal input portion 410 of the power supply unit 4, excess stress may be applied to a lead terminal of the plug connector 594 and a solder joint portion between the lead terminal and a conductor of the second print wiring board 50.

In contrast, the power supply device A2 of Embodiment 1 has an advantage in that the stress applied to the solder joint portion of the signal output portion 502 is relatively relaxed, because the signal input portion 410 and the signal output portion 502 are connected via the signal cable 503.

Note that although the second case 59 in the present embodiment is constituted by coupling two components made of synthetic resin molded articles, the second case 59 may be constituted by one component made of a synthetic resin molded article, similarly to the second case 51 in Embodiment 1.

Figure 23A:
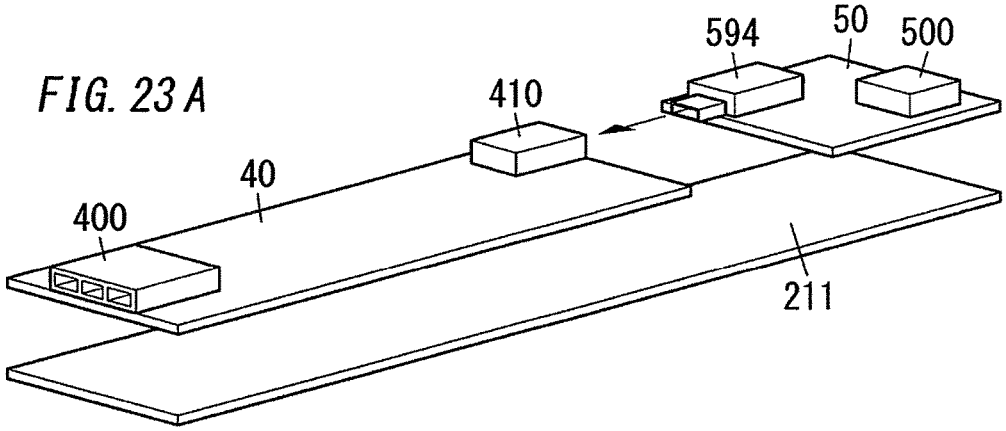
FIGS. 23A to 23C are perspective views illustrating a first print wiring board and a second print wiring board in Embodiment 2.
Figure 23B:
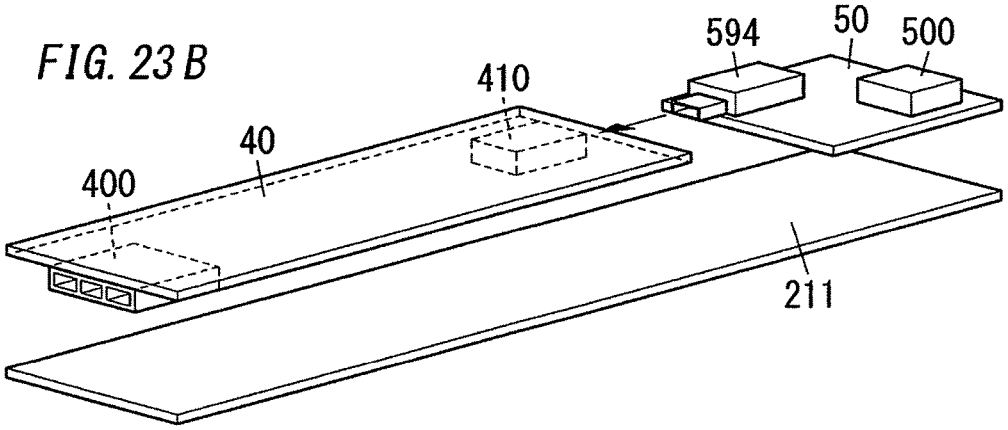

Here, in the power supply device A2 of the present embodiment, the surface of a first print wiring board 40 on which the signal input portion 410 is mounted and the surface of the second print wiring board 50 on which the plug connector 594 is mounted face opposite directions, as shown in FIG. 23B. Therefore, the direction of the lead terminal of the receptacle connector used as the signal input portion 410 needs to be opposite to the direction of the lead terminal of the plug connector 594, and as a result general-purpose connectors are difficult to use.

Figure 23C:
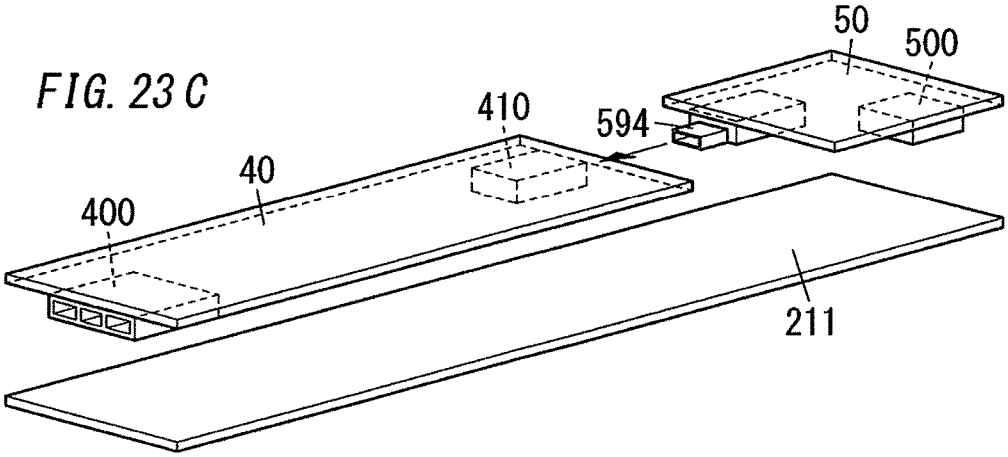

On the other hand, if the surfaces of the first print wiring board 40 and the second print wiring board 50 are on the same side, as shown in FIGS. 23A and 23C, the directions of the lead terminals of the receptacle connector and the plug connector 594 are the same, and as a result general-purpose connectors can be used.

Embodiment 3

A power supply device A2 according to Embodiment 3 will be described in detail with reference to FIGS. 24 and 25. Note that the power supply device A2 of the present embodiment is characterized by a mounting structure for mounting a second case 58 of the functional unit 5 to the first case 42 of the power supply unit 4, and the other configurations are basically in common with one of the power supply devices A2 of Embodiments 1 and 2. Accordingly, constituent elements in common with one of the power supply devices A2 of Embodiments 1 and 2 are provided with the same reference numerals, and illustration and description thereof will be omitted as appropriate.

Figure 24:
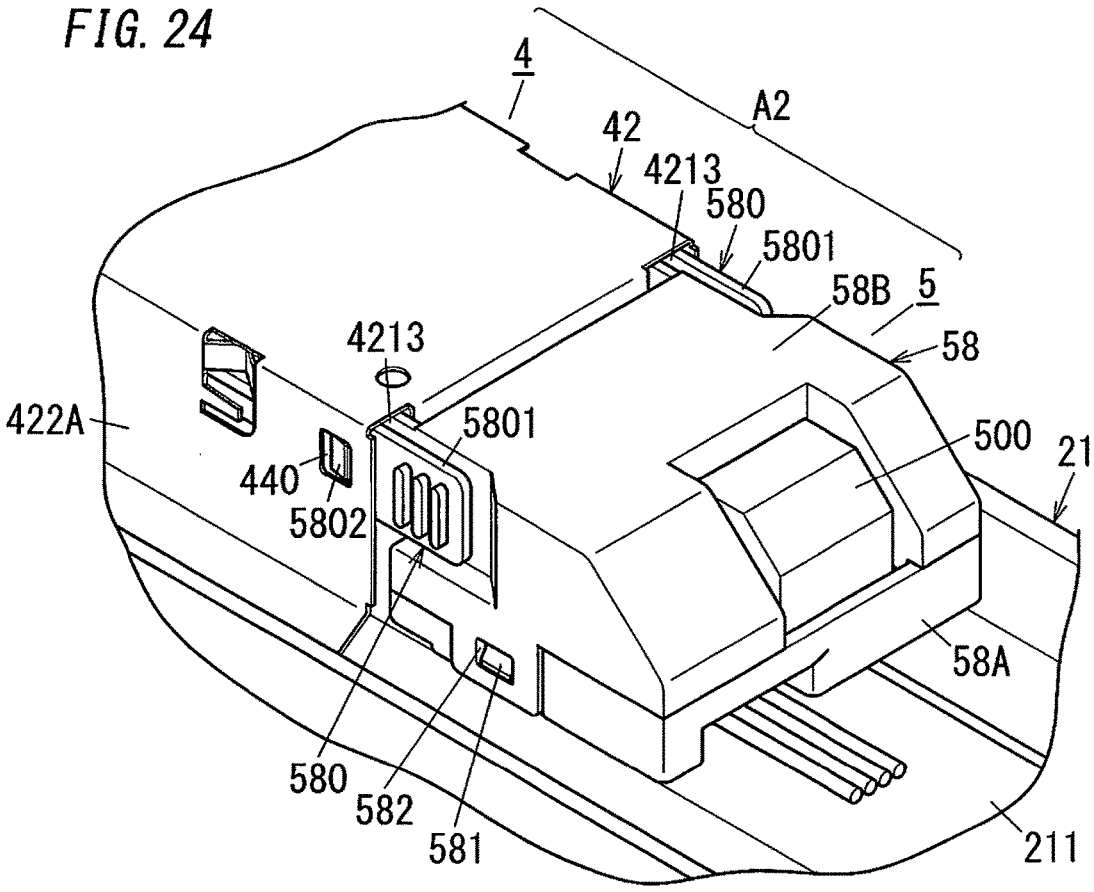
FIG. 24 is a partial perspective view of a power supply device according to Embodiment 3.

The second case 58 in the present embodiment includes a second case body 58A and a second case cover 58B, as shown in FIG. 24. The second case body 58A is constituted by a synthetic resin molded article shaped like a box in which an upper surface is open, and houses therein a second print wiring board 50A (refer to FIG. 25). The second print wiring board 50A is formed in a polygonal flat plate-like shape, an external signal input portion 500 is mounted on a front side (right side in FIG. 25) thereof, and a plug connector 502A corresponding to a signal output portion is mounted on a back side (left side in FIG. 25) thereof, as shown in FIG. 25. Also, two protruding portions 581 are respectively provided on left and right side walls of the second case body 58A. The second case cover 58B is constituted by a synthetic resin molded article shaped like a box whose lower surface and back surface are open. Two rectangular through holes 582 (one only is shown in FIG. 24) are provided on left and right side walls of the second case cover 58B. The second case body 58A and second case cover 58B are coupled by the protruding portions 581, which form a pair, being respectively fitted to the through holes 582, which form a pair, and as a result the second case 58 is assembled, as shown in FIG. 24.

Figure 25:
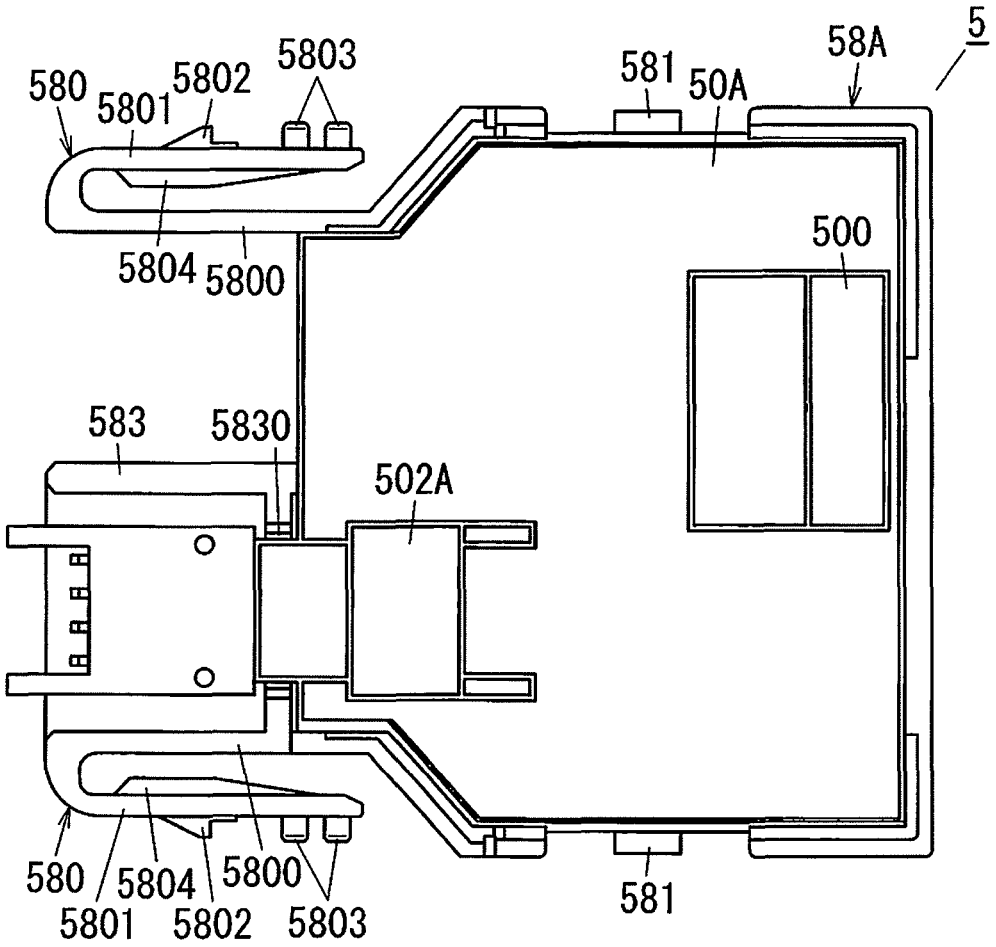
FIG. 25 is a partial plan view of a functional unit in Embodiment 3.

It is preferable that the second case body 58A is provided integrally with a pair of coupling male portions (two coupling male portions) 580, as shown in FIG. 25. The coupling male portions 580, which form a pair, each include a support piece 5800, a bending piece 5801, and a protruding portion 5802. The support piece 5800 is shaped like a rectangular plate, and is configured to project backward from a back end of a left side wall or a right side wall of the second case body 58A. The bending piece 5801 is shaped like a rectangular plate, and projects forward from a front end (back end) of the support piece 5800, and is configured to be able to bend in a thickness direction (horizontal direction) using a front end portion thereof as a fulcrum. The protruding portion 5802 is shaped like a triangular prism, and is provided on an outside surface of the bending piece 5801 (a side surface that does not oppose the support piece 5800, the same applies hereinafter). Also, two or more ribs 5803 are provided on an outside surface of a front end portion of the bending piece 5801. These two or more ribs 5803 serve as an antislip means when a person (operator or installer) holds the tip of the bending piece 5801 by fingers. Furthermore, a stopper 5804 shaped like a protrusion that projects toward the support piece 5800 is integrally provided on an inner side surface (a side surface that opposes the support piece 5800, the same applies hereinafter) of the bending piece 5801. The pair of coupling male portions 580 corresponds to a first mounting mechanism.

Also, a protection portion 583 that projects backward is integrally provided on a back wall of the second case body 58A, as shown in FIG. 25. The protection portion 583 is formed in a rectangular box-like shape whose upper surface and back surface are open. Note that a left side wall of the protection portion 583 is integrally formed with the support piece 5800 of one of the coupling male portions 580. A groove 5830 is provided on a front wall of the protection portion 583, and a tip of the plug connector 502A is inserted into the groove 5830.

The two coupling male portions 580 are mechanically coupled to the respective coupling female portions 440, which form a pair, provided in the first case 42 of the power supply unit 4. The two coupling female portions 440 are respectively constituted by rectangular holes that are provided in a pair of second side plates 422A and 422B, as shown in FIG. 24. Also, through holes 4213, which form a pair, to which the coupling male portions 580 are respectively inserted are respectively provided at a left end and a right end of the first side plate 421A of the first case 42. Furthermore, the first side plate 421A is provided with a rectangular through hole, and the plug connector 502A is plugged into the signal input portion 410 via the through hole. The pair of coupling female portions 440 corresponds to a second mounting mechanism.

When the two coupling male portions 580 are inserted into the respective two through holes 4213, each bending piece 5801 bends due to the protruding portion 5802 being pressed by an edge of the through hole 4213. When each protruding portion 5802 reaches the position of the coupling female portion 440, the bending piece 5801 returns, and as a result the protruding portion 5802 fits into the coupling female portion 440. As a result, the coupling female portions 440 of the first case 42 are respectively coupled to the coupling male portions 580 of the second case 58, and the second case 58 is mounted to the first case 42.

In a state in which the first case 42 is coupled to the second case 58, the signal input portion 410 of the power supply unit 4 is mechanically and electrically connected to the plug connector 502A of the functional unit 5. In this state, the signal input portion 410 is protected by being surrounded by the protection portion 583 provided in the second case 58 (second case body 58A).

Also, when the bending piece 5801 is bent by a finger in each of the two coupling male portions 580, the protruding portion 5802 is released from the coupling female portion 440, and as a result the second case 58 of the functional unit 5 can be unmounted from the first case 42 of the power supply unit 4. At this time, each bending piece 5801 is prevented from being excessively bent due to the stopper 5804 provided in the bending piece 5801 abutting on the support piece 5800.

The power supply device A2 of the present embodiment, as described above, has an advantage in that the attachment and detachment work of the second case 58 to and from the first case 42 is relatively easy compared with the power supply devices A2 in Embodiments 1 and 2. Also, when an external force is applied to the functional unit 5, the stress is applied to the pair of coupling male portions 580 and the pair of coupling female portions 440 and the stress is unlikely to be applied to the signal input portion 410 and the plug connector 502A, and as a result reliability of electrical connection between the power supply unit 4 and the functional unit 5 can be improved. Note that, in the power supply device A2 of the present embodiment, the coupling female portion may be provided in the second case 58 of the functional unit 5, and the coupling male portion may be provided in the first case 42 of the power supply unit 4.

Embodiment 4

Figure 26:
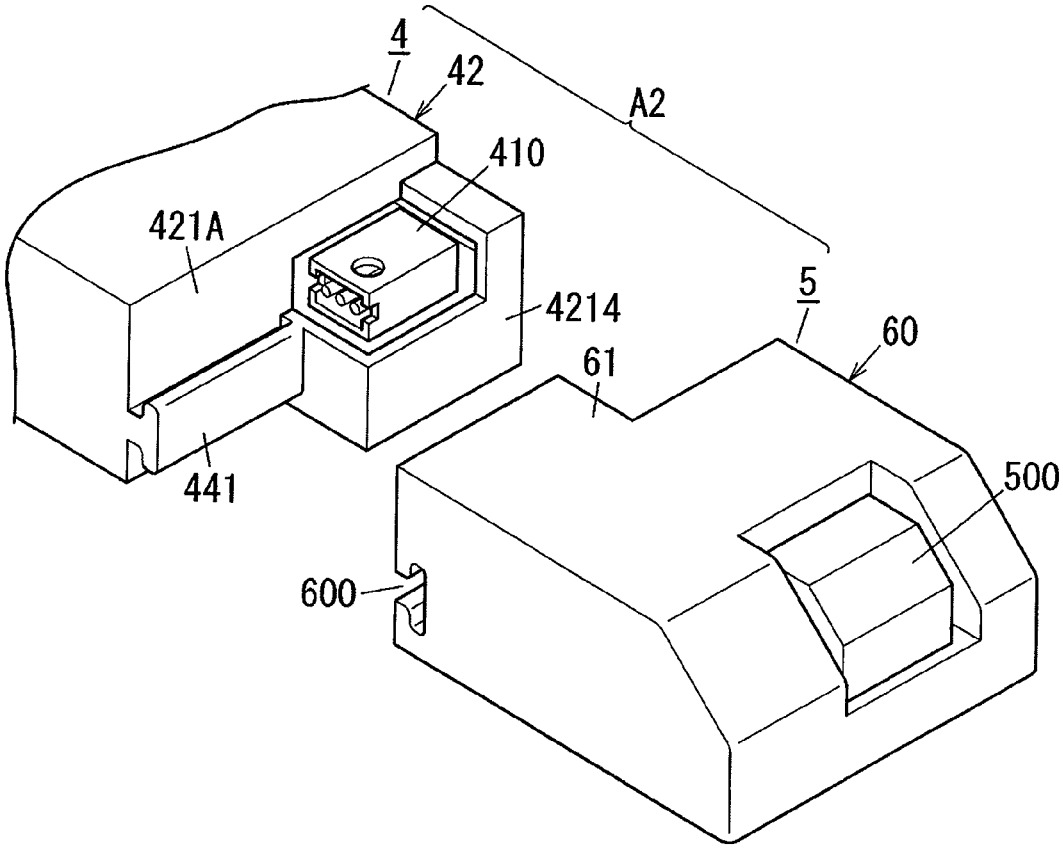
FIG. 26 is a partial perspective view of a power supply device according to Embodiment 4.

A power supply device A2 according to Embodiment 4 will be described in detail with reference to FIG. 26. Note that the power supply device A2 of the present embodiment is characterized by a mounting structure for mounting a second case 60 of the functional unit 5 to the first case 42 of the power supply unit 4, and the other configurations are basically in common with one of the power supply devices A2 of Embodiments 1 to 3. Accordingly, constituent elements in common with one of the power supply devices A2 of Embodiments 1 to 3 are provided with the same reference numerals, and illustration and description thereof will be omitted as appropriate.

In the power supply device A2 of the present embodiment, a coupling male portion 441 is provided in a first case 42 of a power supply unit 4, and a coupling female portion 600 is provided in a second case 60 of a functional unit 5. The coupling male portion 441 includes a protrusion in which the cross-section thereof in a plane orthogonal to a longitudinal direction has a T-like shape, and is provided on a first side plate 421A of the first case 42. Also, the first side plate 421A is provided with a support board 4214 that supports the signal input portion 410. The support board 4214 includes a protrusion having an L-like shape when viewed in a front-back direction, and is configured to support the signal input portion 410 such that the plug connector is inserted and removed in parallel to the first side plate 421A. The coupling female portion 600 corresponds to a first mounting mechanism. The coupling male portion 441 corresponds to a second mounting mechanism.

The second case 60 differs in structure from the second case 51 of Embodiment 1 in that a wall is provided in a front surface. Also, in a front wall of the second case 60, a projecting portion 61 that projects forward (toward a power supply unit 4) from a part of the wall is provided. A signal output portion (plug connector) is housed in the projecting portion 61 so as to project a tip thereof.

The coupling female portion 600 is constituted by a recessed portion that has a T-like shape when viewed in a horizontal direction and is provided in the projecting portion 61 of the second case 60. The recessed portion (coupling female portion 600) is constituted so as to be open in left and right side surfaces of the projecting portion 61.

When the second case 60 is moved relative to the first case 42 such that the coupling male portion 441 is inserted into the coupling female portion 600, the coupling male portion 441 is fitted into the coupling female portion 600, and as a result the first case 42 is coupled to the second case 60. At this time, the signal output portion (plug connector) that projects from the projecting portion 61 is plugged into the signal input portion 410 supported by the support board 4214.

The power supply device A2 of the present embodiment as described above has an advantage in that operations for attaching and detaching the second case 60 to and from the first case 42 are easy compared with the power supply devices A2 of Embodiments 1 and 2. Also, when an external force is applied to the functional unit 5, the stress is applied to the coupling male portion 441 and the coupling female portion 600 and the stress is unlikely to be applied to the signal input portion 410 and the plug connector, and as a result reliability of electrical connection between the power supply unit 4 and the functional unit 5 can be improved.

Embodiment 5

Figure 27:
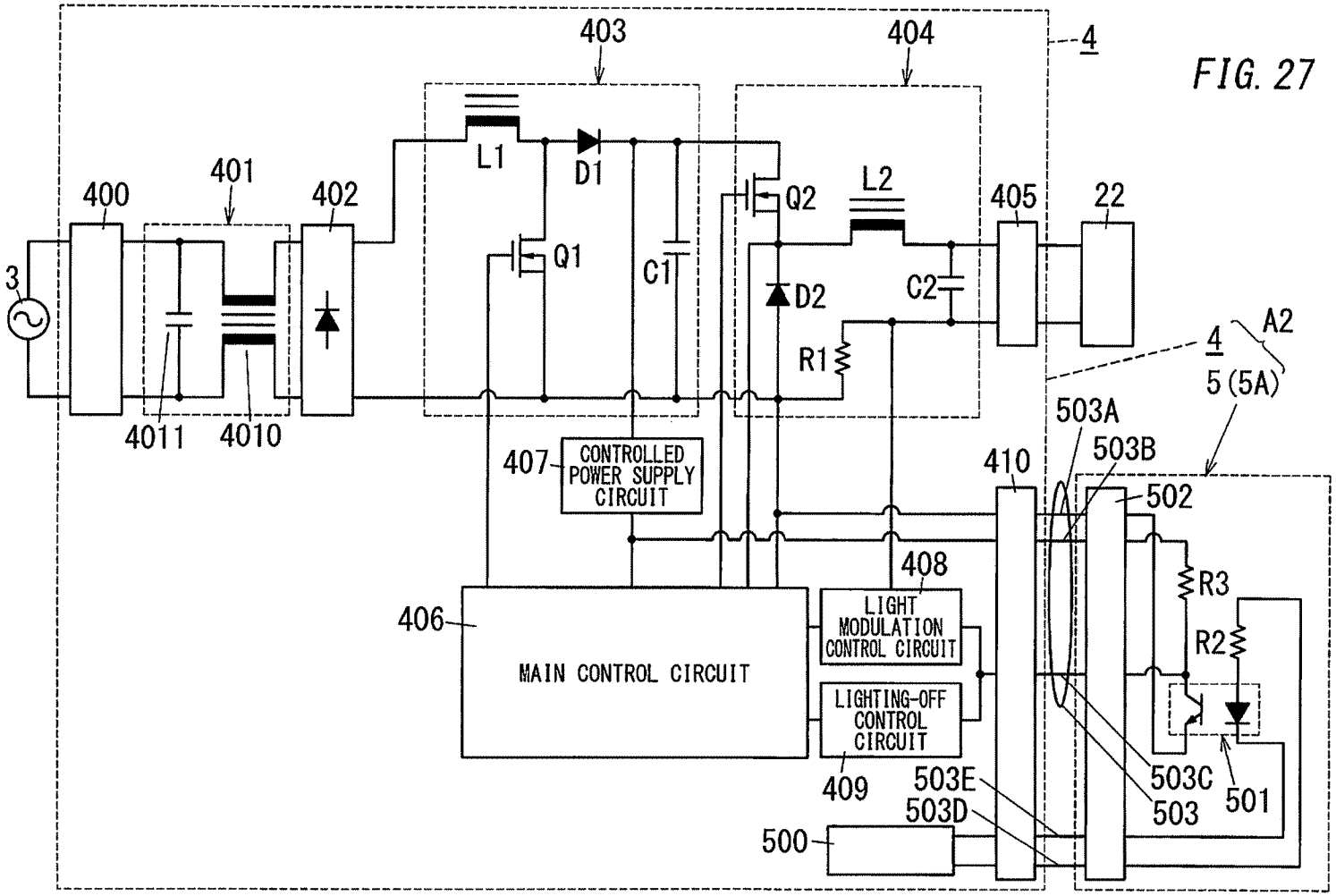
FIG. 27 is a circuit diagram of a power supply unit and a functional unit in a power supply device according to Embodiment 5.
Figure 28:
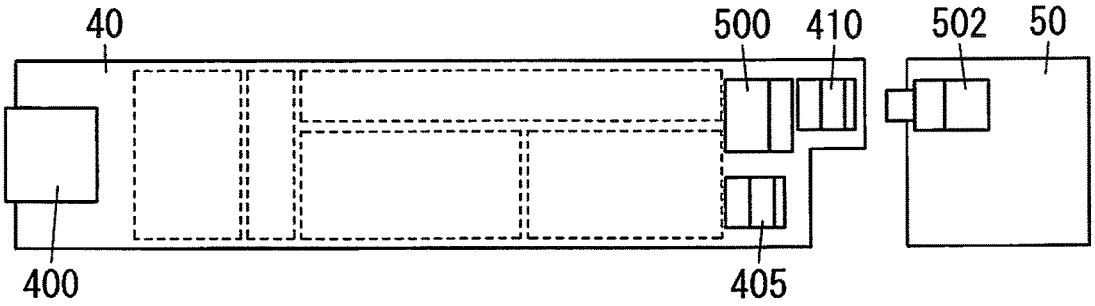
FIG. 28 is a plan view illustrating a first print wiring board and a second print wiring board in Embodiment 5.

A power supply device A2 according to Embodiment 5 will be described in detail with reference to FIGS. 27 and 28. Note that because the basic configuration of the power supply device A2 of the present embodiment is in common with the power supply device A2 of Embodiment 1, constituent elements in common with the power supply devices A2 of Embodiment 1 are provided with the same reference numerals, and illustration and description thereof will be omitted.

It is preferable that, in the power supply device A2 of the present embodiment, an external signal input portion 500 that is electrically connected to a signal line on which an external control signal is transmitted is mounted on a first print wiring board 40 of the power supply unit 4. Furthermore, it is preferable that, in the power supply device A2 of the present embodiment, the external signal input portion 500 is electrically connected to output terminals of a photocoupler 501 of a functional unit 5 via a signal output portion 502, two electric wires 503D and 503E of the signal cable 503, and a signal input portion 410. Note that the external signal input portion 500 is preferably mounted on a second end portion 4002 of the first print wiring board 40 similarly to the signal input portion 410 and a power supply output portion 405, as shown in FIG. 28.

In the power supply device A2 of the present embodiment, because the external signal input portion 500 is mounted on the first print wiring board 40, stress is not applied to the signal input portion 410 and the signal output portion 502 even in a case where the signal line connected to the external signal input portion 500 is pulled. Accordingly, in the power supply device A2 of the present embodiment, reliability of electrical connection between the power supply unit 4 and the functional unit 5 can be improved compared with the power supply devices A2 of Embodiments 1 to 4.

Figure 29A:
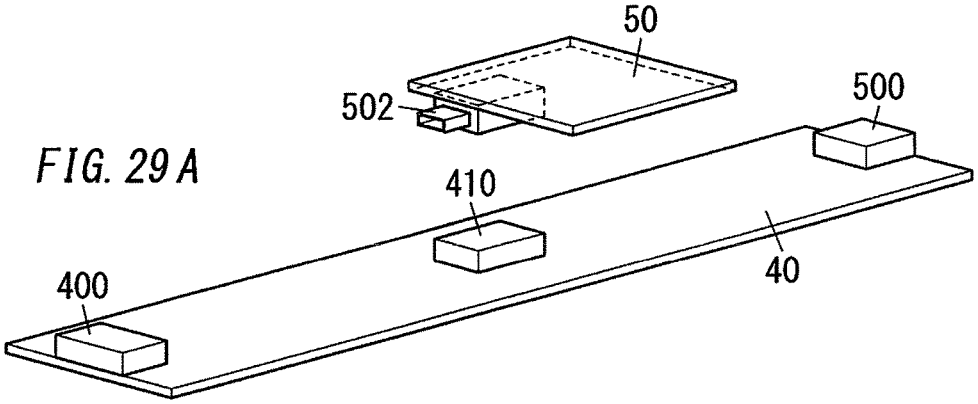
FIGS. 29A to 29C are perspective views illustrating the first print wiring board and the second print wiring board in Embodiment 5.
Figure 29B:
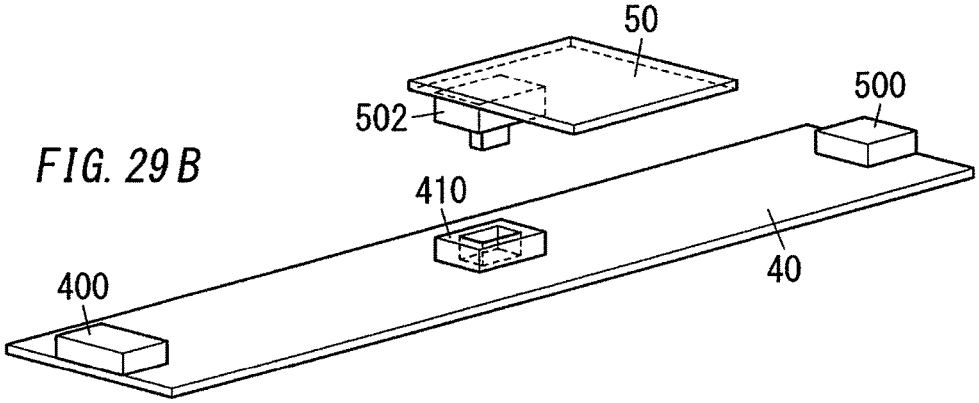

Incidentally, the signal input portion 410 may be mounted at a position in the vicinity of a central portion of the first print wiring board 40 in a longitudinal direction B11, as shown in FIGS. 29A and 29B. In the configuration shown in FIG. 29A, the signal output portion (plug connector) 502 that is mounted on the second print wiring board 50 is inserted to and removed from the signal input portion 410 in a direction parallel to a surface of the first print wiring board 40. Also, in the configuration shown in FIG. 29B, the signal output portion (plug connector) 502 that is mounted on the second print wiring board 50 is inserted to and removed from the signal input portion 410 in a direction orthogonal to the surface of the first print wiring board 40. Furthermore, in the configuration shown in FIG. 29C, an end portion of the second print wiring board 50 is directly plugged into the signal input portion 410. Note that in any of the configurations in FIGS. 29A to 29C, the external signal input portion 500 is preferably mounted on a second end portion 4002 of the first print wiring board 40.

Figure 30:
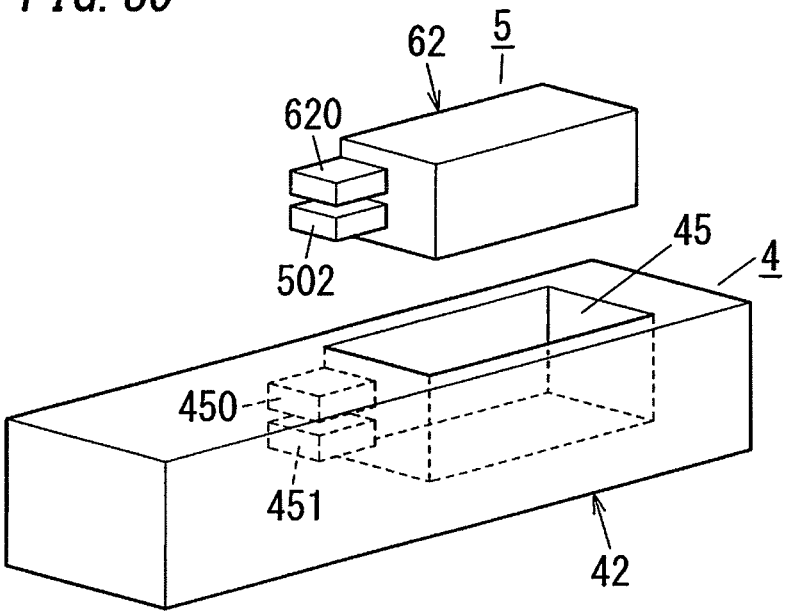
FIG. 30 is a perspective view of the power supply unit and the functional unit in Embodiment 5.

In the configuration shown in FIG. 29A, the functional unit 5 is preferably configured such that the signal output portion 502 and a coupling male portion 620 project from a side surface of a second case 62 shaped like a rectangular parallelepiped, as shown in FIG. 30. The coupling male portion 620 includes a projecting portion shaped like a rectangular parallelepiped. The coupling male portion 620 corresponds to a first mounting mechanism.

Also, in the configuration shown in FIG. 29A, the first case 42 of the power supply unit 4 is preferably provided with a rectangular recess 45, as shown in FIG. 30. Furthermore, a coupling female portion 450 and a connector housing portion 451 are preferably provided in an inner wall of the recess 45 of the first case 42. The coupling female portion 450 includes a recessed portion into which the coupling male portion 620 is fitted. The connector housing portion 451 houses the signal input portion 410. The coupling female portion 450 corresponds to a second mounting mechanism.

When the functional unit 5 is moved inside the recess 45 of the first case 42 along the longitudinal direction, the signal output portion 502 is plugged into the signal input portion 410, and the coupling male portion 620 is fitted into the coupling female portion 450, and as a result the functional unit 5 is mounted to the power supply unit 4.

Figure 31:
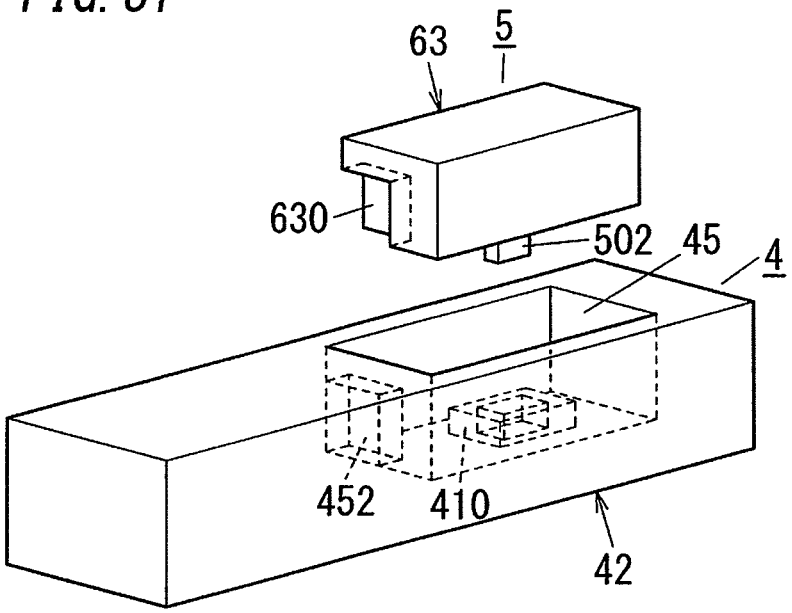
FIG. 31 is a perspective view of the power supply unit and the functional unit having another configuration in Embodiment 5.

Also, in the configuration shown in FIG. 29B, it is preferable that, in the functional unit 5, the signal output portion 502 projects from a lower surface of the second case 63 shaped like a rectangular parallelepiped, and a recessed portion 630 is provided in a corner of the second case 63, as shown in FIG. 31.

Also, in the configuration shown in FIG. 29B, the first case 42 of the power supply unit 4 is preferably provided with a rectangular recess 45, as shown in FIG. 31. Furthermore, the signal input portion 410 is preferably provided on a bottom surface of the recess 45 of the first case 42. Note that a rib 452 shaped like a rectangular parallelepiped is preferably provided in a corner inside the recess 45.

When the functional unit 5 is housed inside the recess 45 of the first case 42, the signal output portion 502 is plugged into the signal input portion 410, the rib 452 is fitted into the recessed portion 630, and the functional unit 5 is mounted to the power supply unit 4.

Figure 29C:
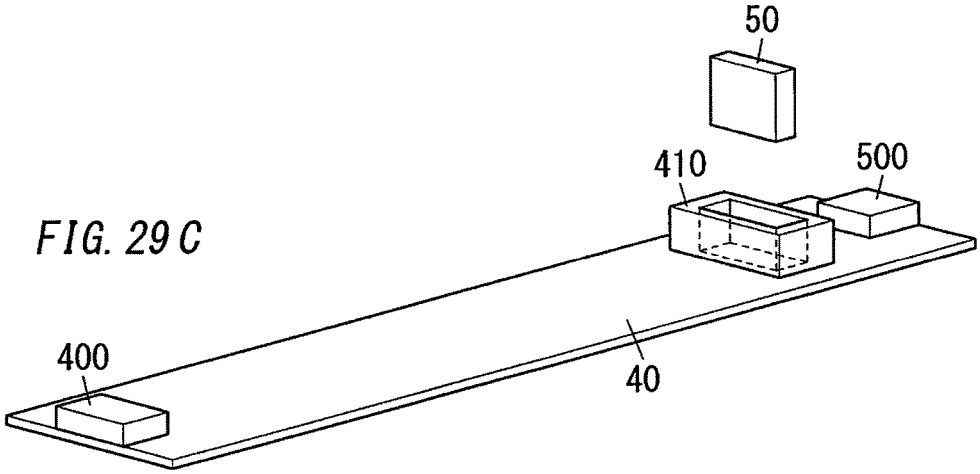

In any of the configurations in FIG. 29A to 29C, when the external signal input portion 500 is mounted to the first print wiring board 40, stress is not applied to the signal input portion 410 and the signal output portion 502 even in a case where the signal line connected to the external signal input portion 500 is pulled. Accordingly, in the power supply device A2 of the present embodiment, reliability of electrical connection between the power supply unit 4 and the functional unit 5 can be improved compared with the power supply devices A2 of Embodiments 1 to 4.

Note that in Embodiments 1 to 5 described above, the first case 42 of the power supply unit 4 may be mounted to the bottom plate 111 of the recessed portion 11 of the fixture body 1 instead of the mounting member 21 of the light source unit 2. Also, the shape of the fixture body 1 is not limited to an elongated flat box-like shape whose upper surface is open, and may have a structure in which the power supply unit 4 and the functional unit 5 are mountable.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A power supply device comprising:

a first case that houses:

a power supply input configured to receive an AC voltage;

a rectifier configured to rectify the AC voltage received by the power supply input;

a capacitor configured to smooth a pulsating voltage outputted from the rectifier;

a power converter configured to convert a first DC voltage into a second DC voltage, the first DC voltage being outputted from the capacitor;

a power supply output configured to output the second DC voltage converted in the power converter;

a signal input configured to receive a control signal;

a processor configured to control the power converter to change a magnitude of the second DC voltage, which is to be outputted from the power supply output, based on the control signal received by the signal input; and a circuit substrate on which the power supply input, the rectifier, the capacitor, the power converter, the power supply output, the signal input, and the processor are mounted, the circuit substrate having a planar rectangular shape, the power supply input being mounted on a first end portion of the circuit substrate in a longitudinal direction, the rectifier, the capacitor, the power converter, the processor, and the power supply output being mounted on the circuit substrate in a stated order from the first end portion toward a second end portion in the longitudinal direction, the signal input being mounted at a position closer to the second end portion than the rectifier in the circuit substrate; and a second case that houses:

a control circuit configured to generate the control signal, and to output the control signal to the signal input; and a first mounting mechanism that enables the second case to be mechanically mounted on the first case, the control circuit including a print wiring board having a planar rectangular shape and a component mounted on the print wiring board, the component being electrically connected to a power supply included in the first case via the signal input, the power supply comprises a second mounting mechanism that is to be coupled to the first mounting mechanism and configured to accommodate the second case to be mechanically mounted on the first case, the second case has a box shape having an open surface, the second case includes a pair of side walls and a pair of fitting portions provided on the pair of side walls, into which respective peripheral portions of the print wiring board inserted from the open surface are fitted, and the second case is mounted to the first case to overlap and close the open surface of the second case by the first case, the first mounting mechanism is provided on first portions of the pair of side walls, the pair of side walls are configured to provide a gap between the first portions of the pair of side walls in the parallel direction of the print wiring board that is smaller than a gap provided between second portions of the pair of side walls provided on the pair of fitting portions, a step structure is provided at a portion of each of the side walls disposed between the fitting portion and the first mounting mechanism, and the pair of side walls are configured such that gaps are formed between the first portions, which are provided on the first mounting mechanism, and the second portions, which are provided on the fitting portion, by the step structures.

2. The power supply device according to claim 1, wherein the power supply is configured to supply electric power to the component included in the second case.

3. An illumination device comprising:

the power supply device according to claim 1; and an illumination load that is lighted by the second DC voltage supplied from the power supply device.

4. An illumination device comprising:

the power supply device according to claim 2; and an illumination load that is lighted by the second DC voltage supplied from the power supply device.

* * * * *